US008025332B2

(12) United States Patent
Tsonev et al.

(10) Patent No.: US 8,025,332 B2
(45) Date of Patent: Sep. 27, 2011

(54) ITEM OF TRANSFORMABLE FURNITURE

(75) Inventors: Mladen Minkov Tsonev, Sofia (BG); Ilian Vladimirov Milinov, Sofia (BG)

(73) Assignee: ORT Joint Stock Company, Sofia (BG)

( * ) Notice: Subject to any disclaimer, the term of this patent is extended or adjusted under 35 U.S.C. 154(b) by 13 days.

(21) Appl. No.: 12/093,911

(22) PCT Filed: Sep. 16, 2007

(86) PCT No.: PCT/IB2007/002674

§ 371 (c)(1), (2), (4) Date: May 15, 2008

(87) PCT Pub. No.: WO2008/032199

PCT Pub. Date: Mar. 20, 2008

(65) Prior Publication Data

US 2008/0296936 A1 Dec. 4, 2008

(30) Foreign Application Priority Data

Sep. 15, 2006 (BG) ..... 109675

(51) Int. Cl.

| | |
|---|---|
| ***A47B 85/04*** | (2006.01) |
| ***A47C 4/00*** | (2006.01) |
| ***A47C 4/28*** | (2006.01) |

(52) U.S. Cl. ..... 297/124; 297/119; 297/58; 297/55; 297/50

(58) Field of Classification Search ..... 297/122–124, 297/118–119, 1, 3, 55–56, 57–59, 50, 47
See application file for complete search history.

(56) References Cited

U.S. PATENT DOCUMENTS

| | | | | | |
|---|---|---|---|---|---|
| 433,795 | A | * | 8/1890 | Knoeller | 182/33.3 |
| 1,157,802 | A | * | 10/1915 | Persson | 297/109 |
| 1,513,651 | A | * | 10/1924 | Stone | 297/122 |
| 1,773,501 | A | * | 8/1930 | Scholnhammer | 297/119 |
| 2,200,193 | A | | 5/1940 | Taylor | |
| 2,554,617 | A | * | 5/1951 | Dion | 297/2 |
| 2,588,574 | A | | 3/1952 | Rizzolo | |
| 2,705,043 | A | * | 3/1955 | Hoven | 297/47 |
| 3,058,776 | A | * | 10/1962 | Collum | 297/122 |
| 3,123,396 | A | * | 3/1964 | Searle | 297/114 |
| 3,420,571 | A | * | 1/1969 | Moore | 297/124 |
| 4,550,950 | A | * | 11/1985 | Fleishman | 297/440.13 |
| 4,662,675 | A | * | 5/1987 | Volpi | 297/124 |
| 5,782,528 | A | * | 7/1998 | Cioncada | 297/60 |
| 5,833,306 | A | * | 11/1998 | Breto | 297/124 |
| 6,435,607 | B1 | * | 8/2002 | Liu | 297/55 |

(Continued)

FOREIGN PATENT DOCUMENTS

| | | |
|---|---|---|
| FR | 0719651 | 2/1932 |

(Continued)

*Primary Examiner* — David Dunn
*Assistant Examiner* — Tania Abraham
(74) *Attorney, Agent, or Firm* — Standley Law Group LLP

(57) ABSTRACT

The invention relates to an item of transformable furniture, more particularly to an item of furniture transformable from a chair into a desk and vice versa, from a desk into a chair. The item of transformable furniture comprises a first plate (5) and a second plate (6), linked to each other by a hinge joint (4), where said two plates can rotate respectively round first and second horizontal (2, 3) axes so that the plates can be moved from a first position as seat and back, respectively, to a second position as front panel (17) and worktop (18), respectively, and vice versa. Said plates are linked by said first and second horizontal axes to a supporting construction, which consists of at least three interconnected folding elements (1, 1', 19).

16 Claims, 43 Drawing Sheets

U.S. PATENT DOCUMENTS

| | | | | |
|---|---|---|---|---|
| 6,899,384 | B1 * | 5/2005 | Tseng | 297/46 |
| 7,025,415 | B1 * | 4/2006 | Wu | 297/119 |
| 7,080,877 | B1 * | 7/2006 | Tsai | 297/23 |
| 7,198,326 | B2 * | 4/2007 | Chen | 297/124 |
| 7,207,623 | B2 | 4/2007 | Milinov | |
| 2006/0071511 | A1 * | 4/2006 | Tseng | 297/16.1 |
| 2006/0145519 | A1 * | 7/2006 | Hardt, II | 297/124 |

FOREIGN PATENT DOCUMENTS

| | | |
|---|---|---|
| FR | 1414427 | 9/1965 |
| FR | 2612754 | 9/1988 |
| FR | 2858192 | 2/2005 |

* cited by examiner

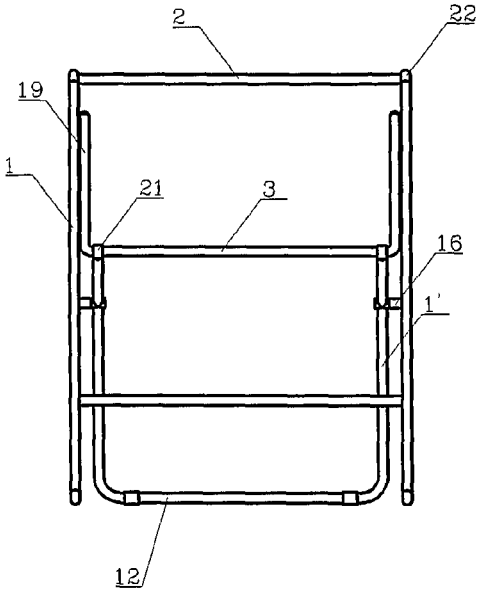
Fig.3a
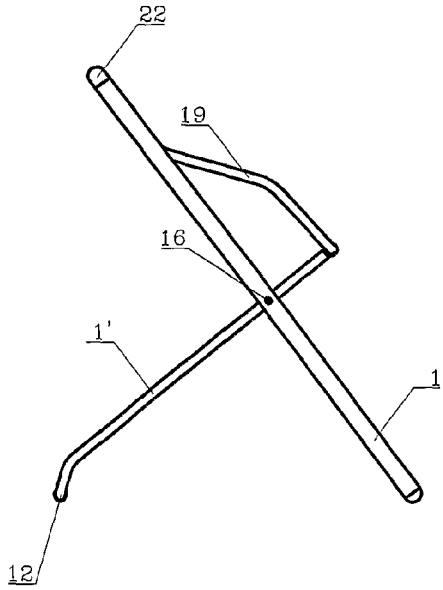
Fig.3b
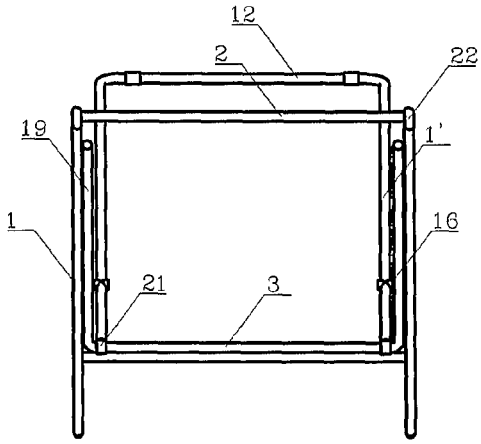
Fig.3c
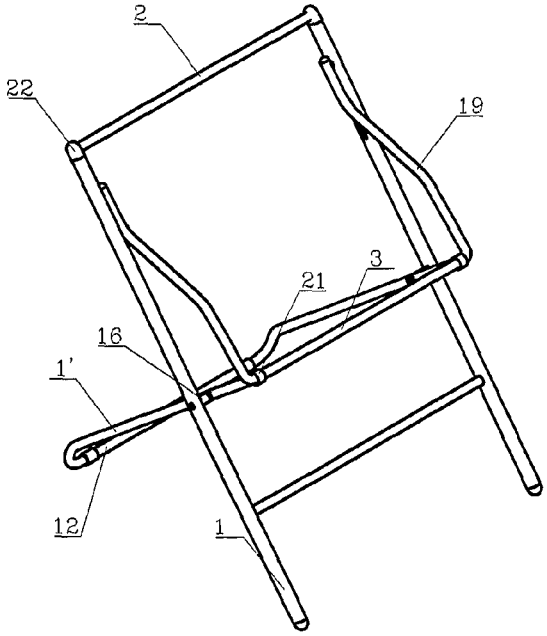
Fig.3d
Fig.3

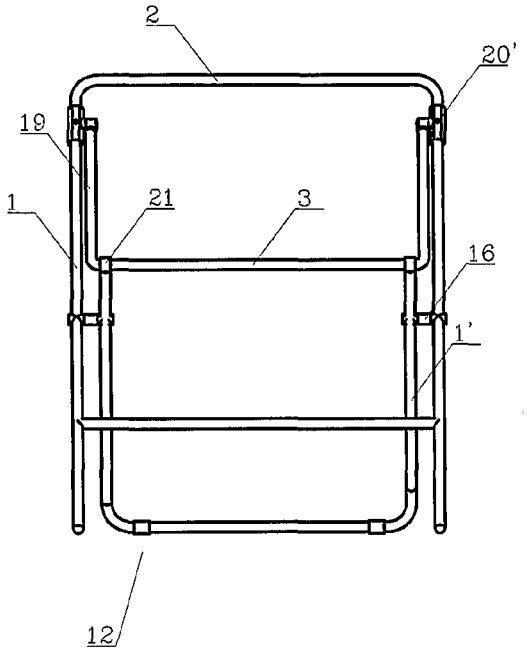
Fig.9a
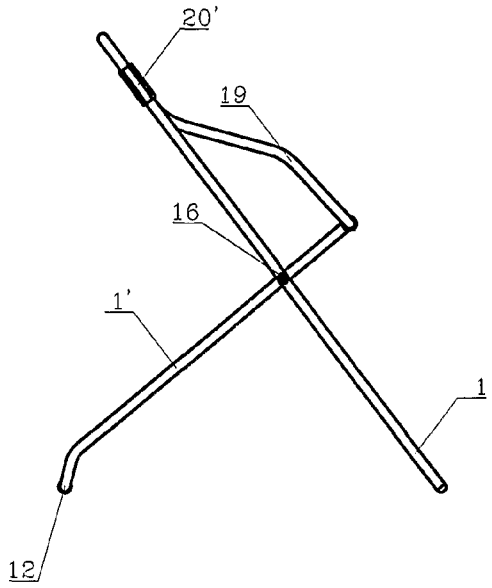
Fig.9b
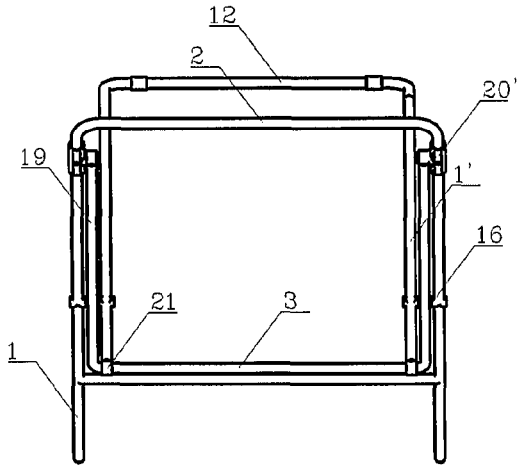
Fig.9c
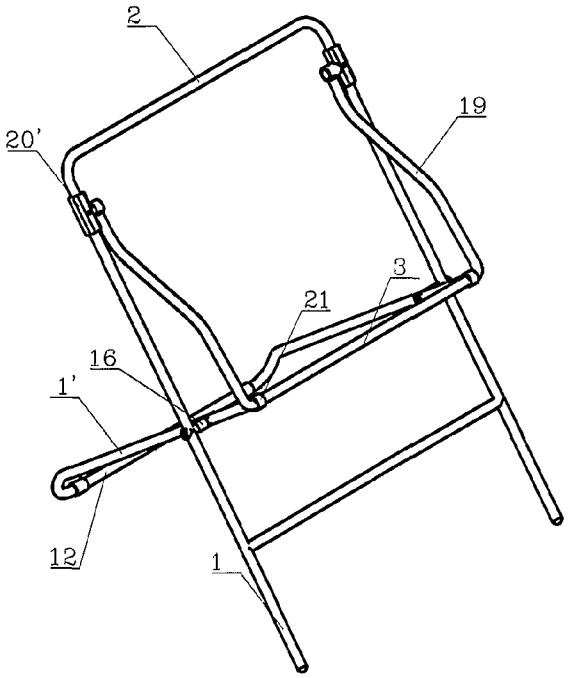
Fig.9d
Fig.9

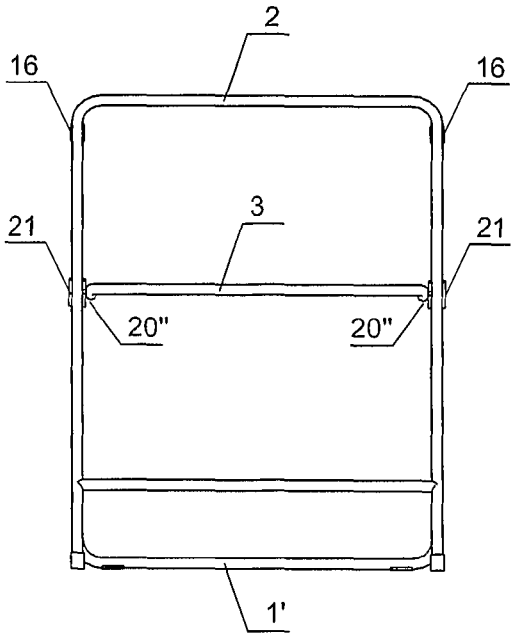
Fig. 21a
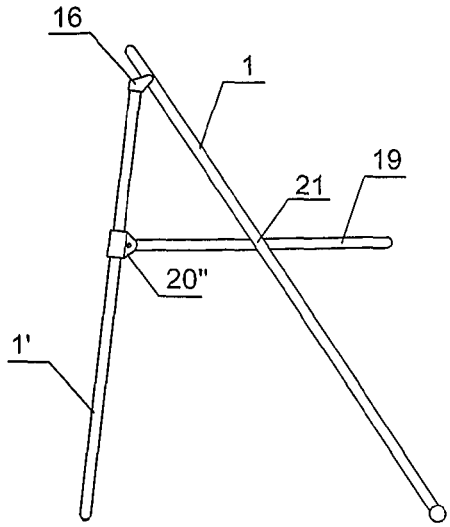
Fig. 21b
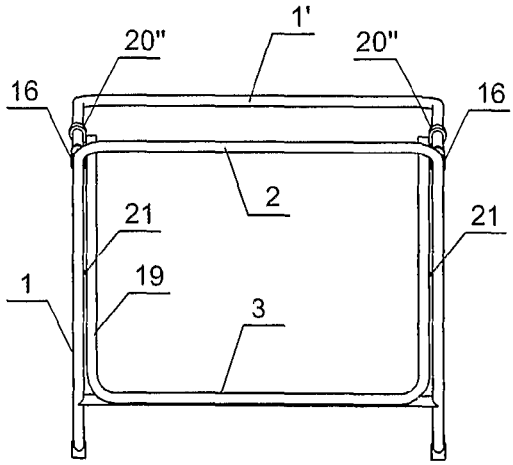
Fig. 21c
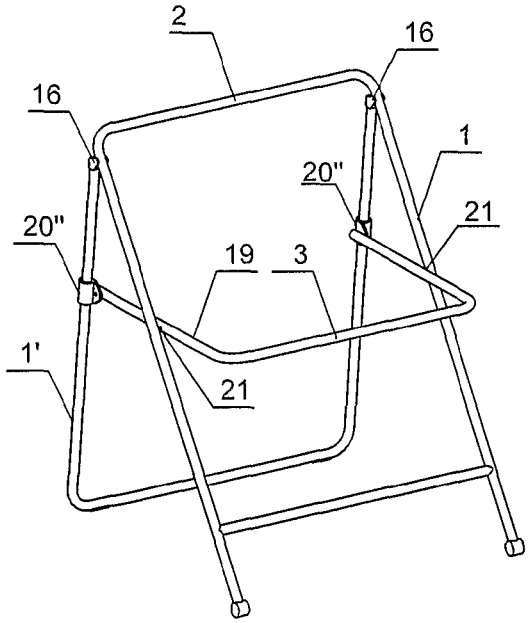
Fig. 21d
Fig. 21

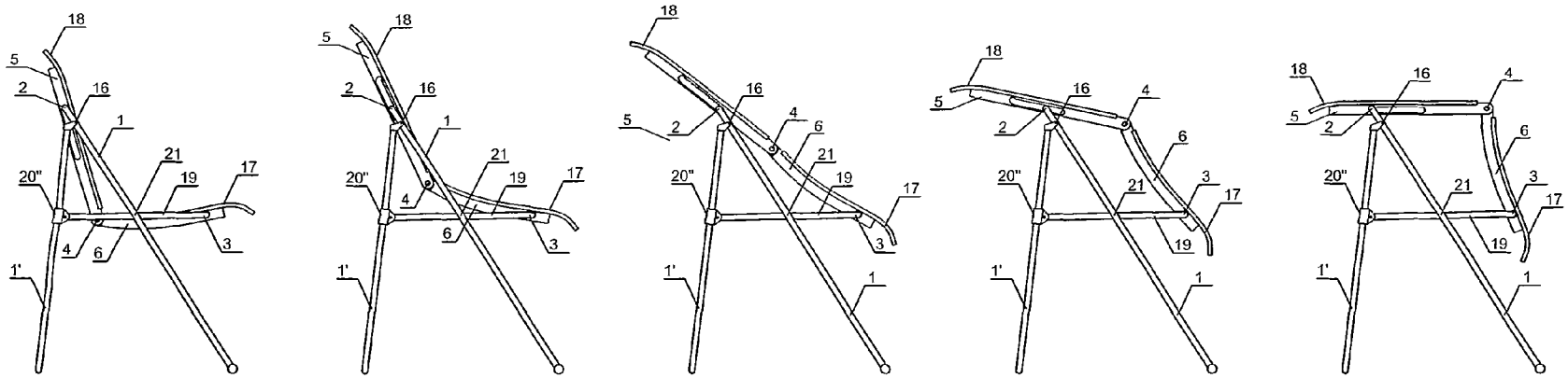
Fig. 22a
Fig. 22b
Fig. 22c
Fig. 22d
Fig. 22e
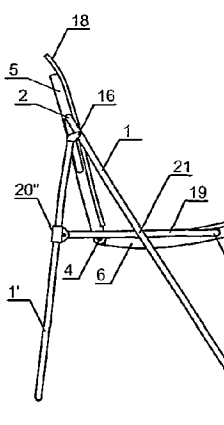
Fig. 22f
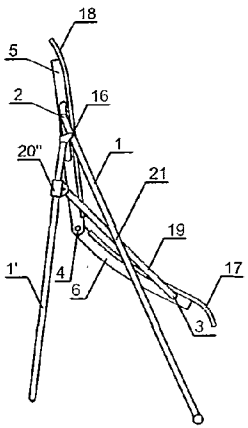
Fig. 22g
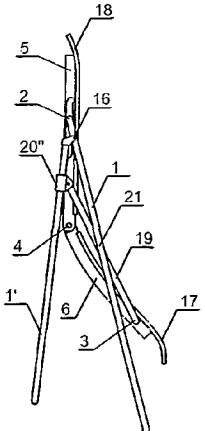
Fig. 22h
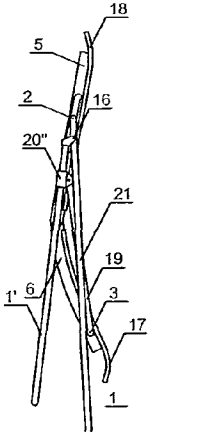
Fig. 22i
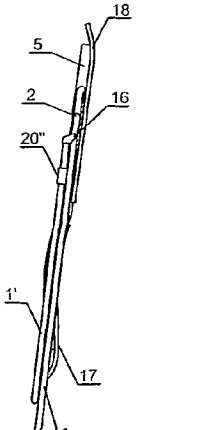
Fig. 22j
Fig. 22

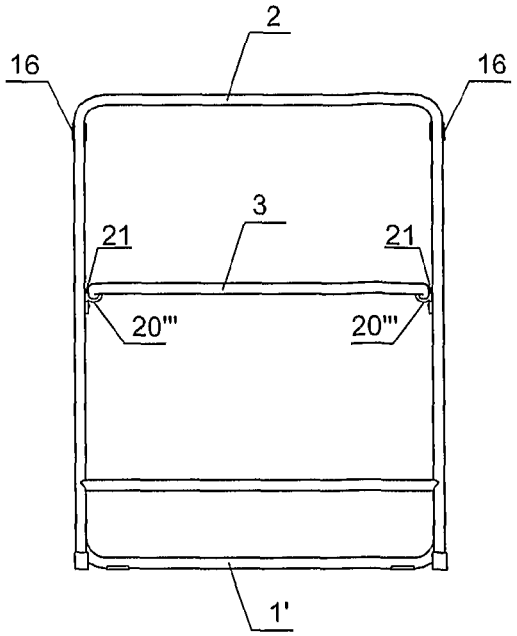
Fig. 26a
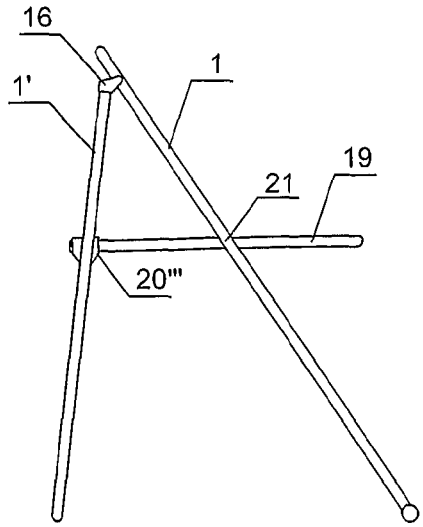
Fig. 26b
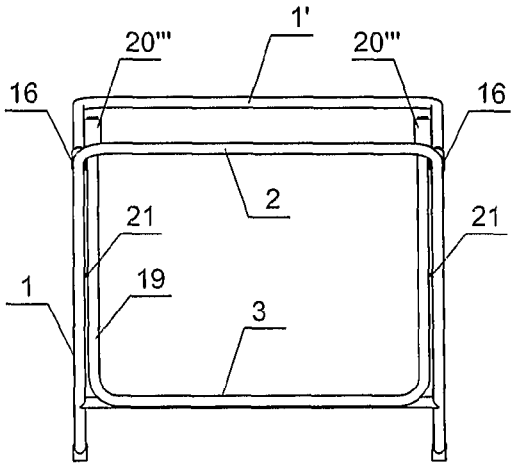
Fig. 26c
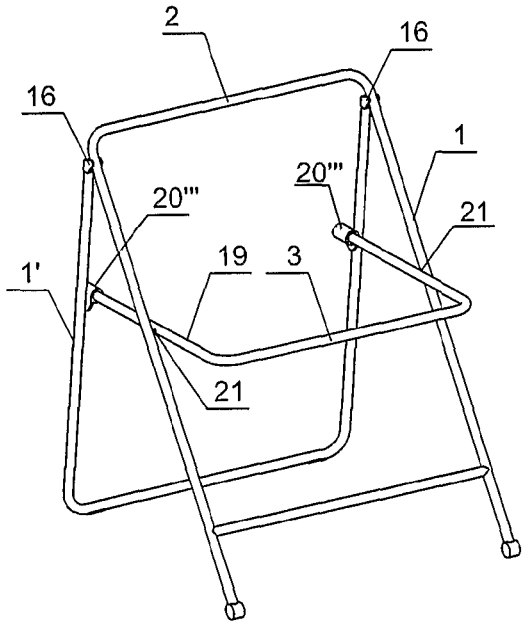
Fig. 26d
Fig. 26

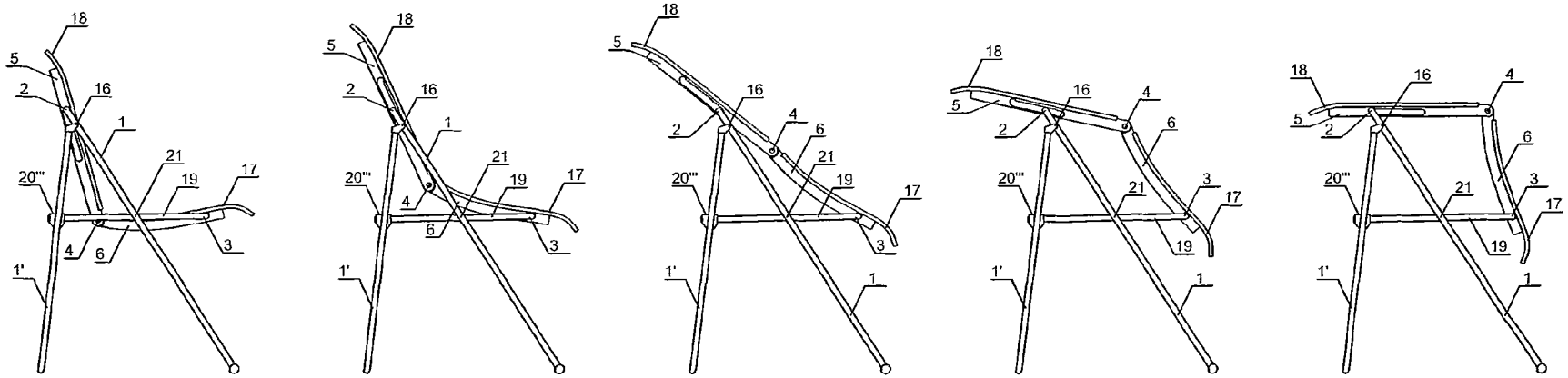
Fig. 27a
Fig. 27b
Fig. 27c
Fig. 27d
Fig. 27e
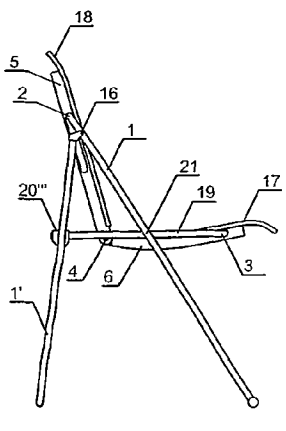
Fig. 27f
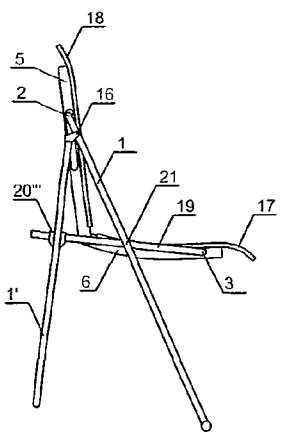
Fig. 27g
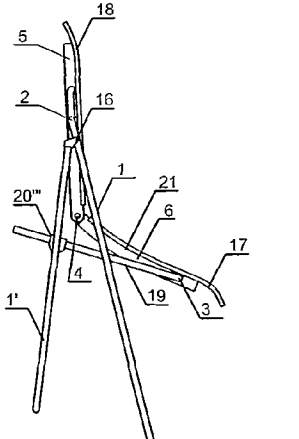
Fig. 27h
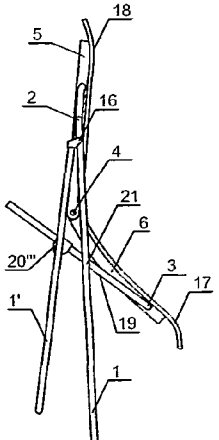
Fig. 27i
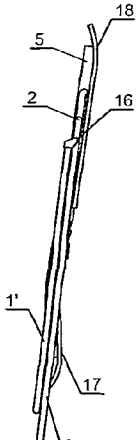
Fig. 27j
Fig. 27

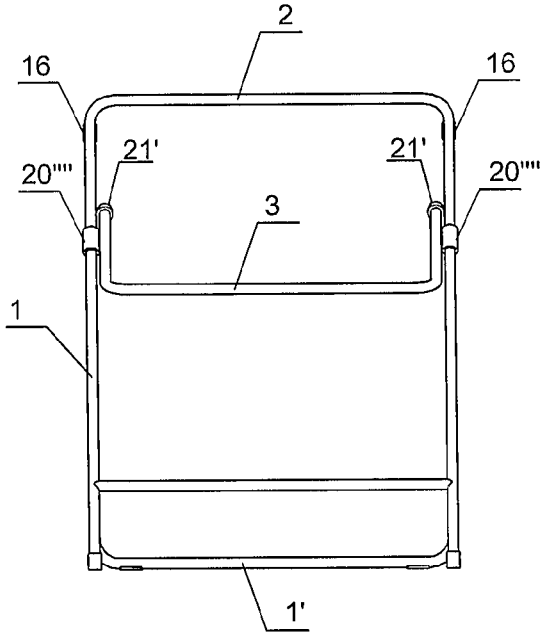
Fig. 31a
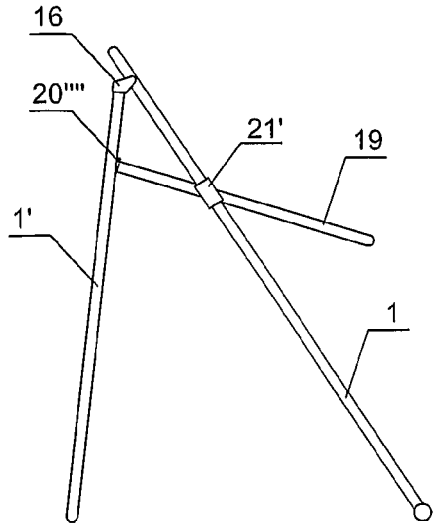
Fig. 31b
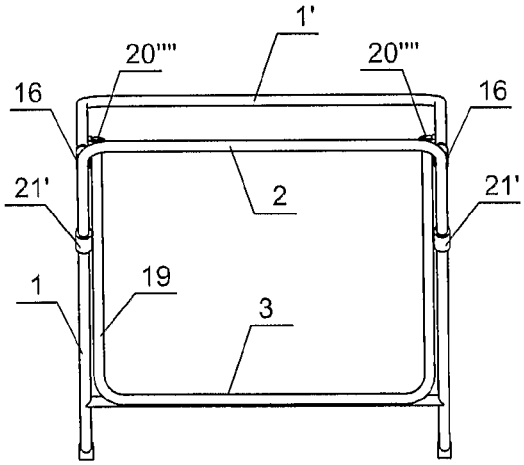
Fig. 31c
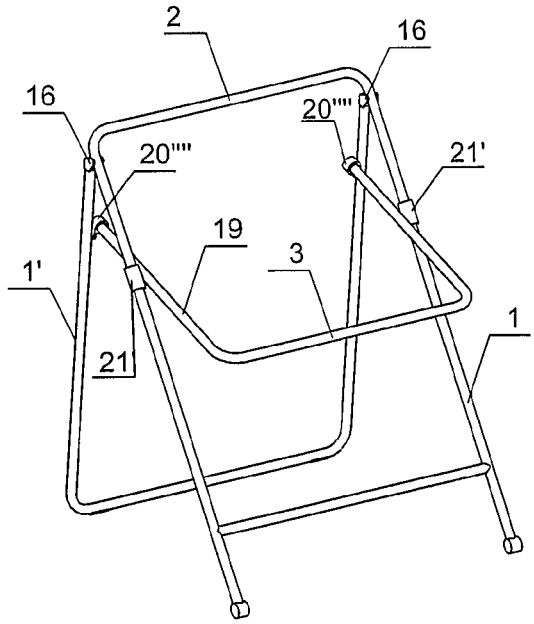
Fig. 31d
Fig. 31

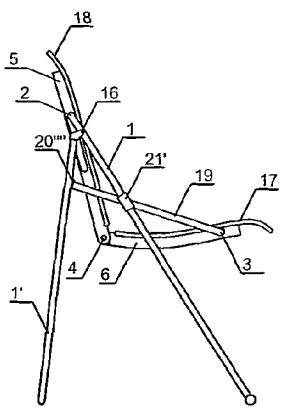
Fig. 32a
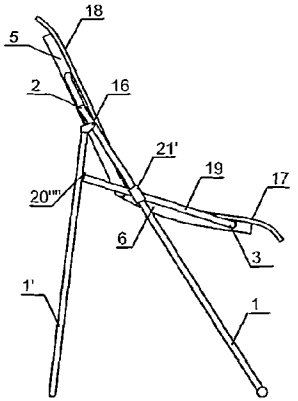
Fig. 32b
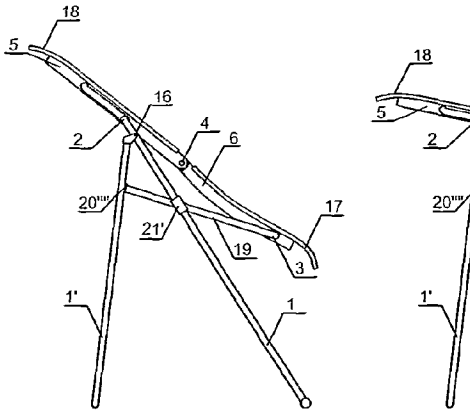
Fig. 32c
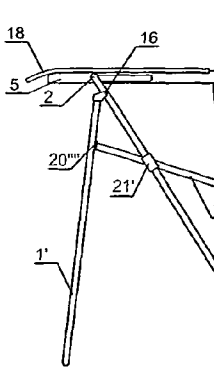
Fig. 32d
Fig. 32e
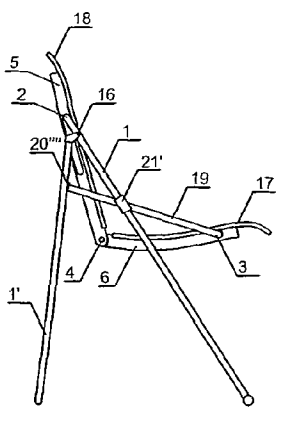
Fig. 32f
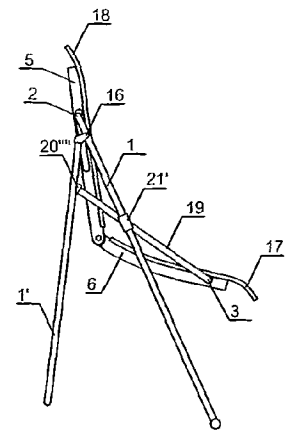
Fig. 32g
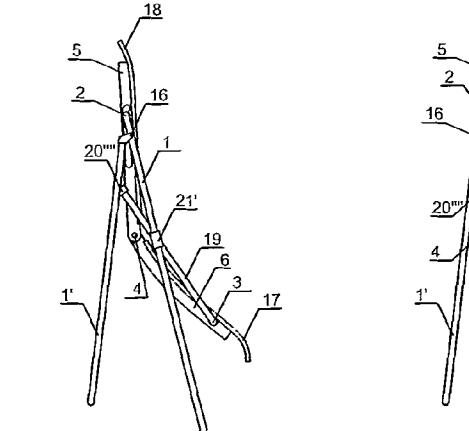
Fig. 32h
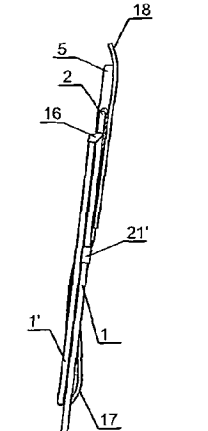
Fig. 32i
Fig. 32j
Fig. 32

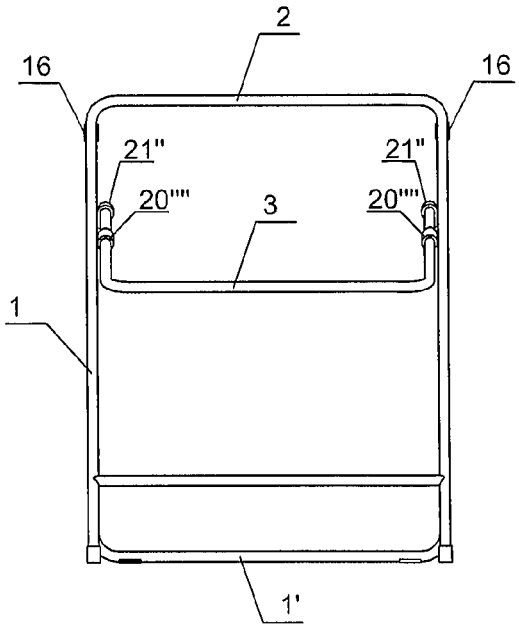
Fig. 36a
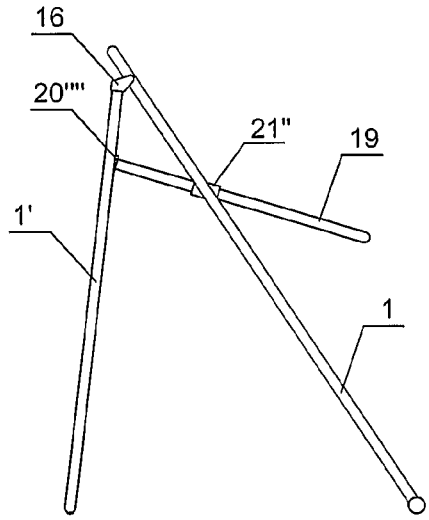
Fig. 36b
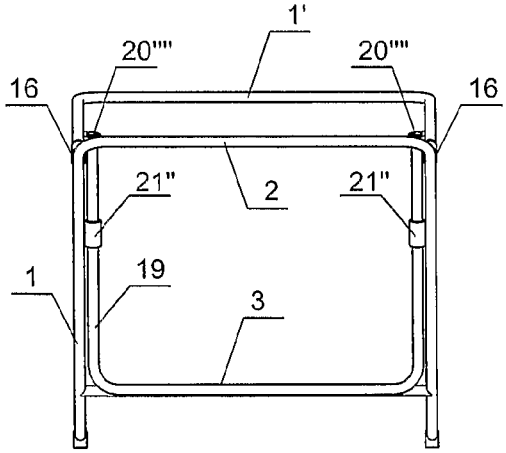
Fig. 36c
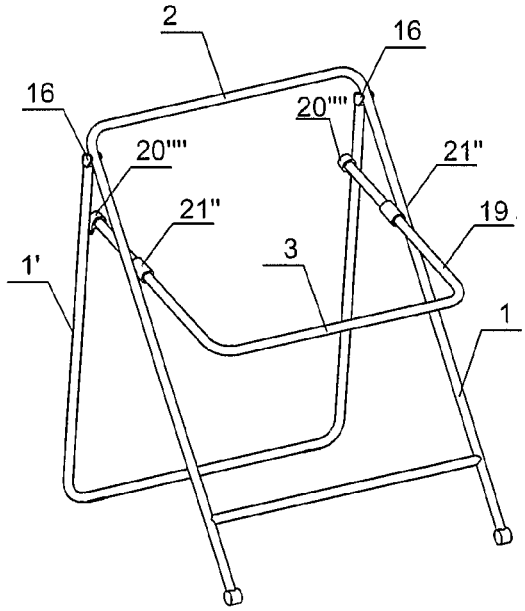
Fig. 36d
Fig. 36

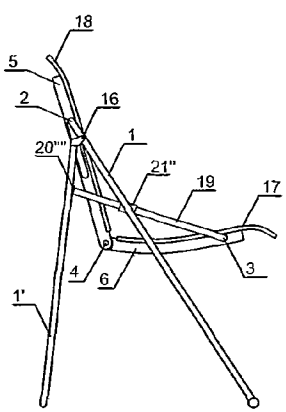
Fig. 37a
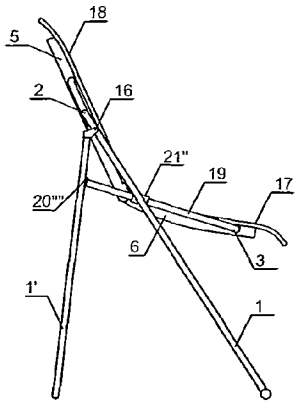
Fig. 37b
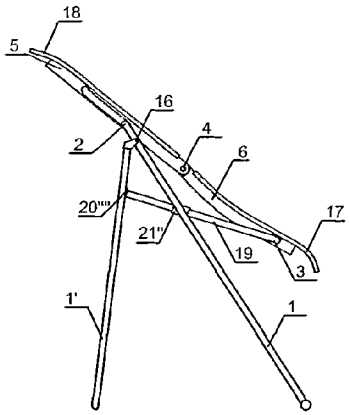
Fig. 37c
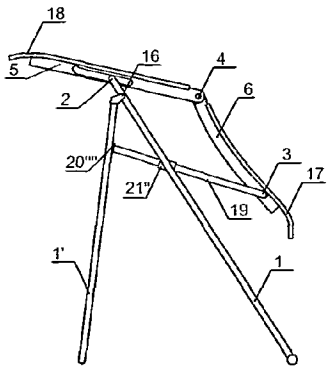
Fig. 37d
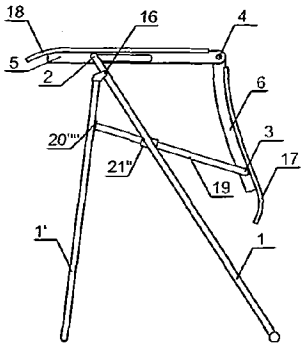
Fig. 37e
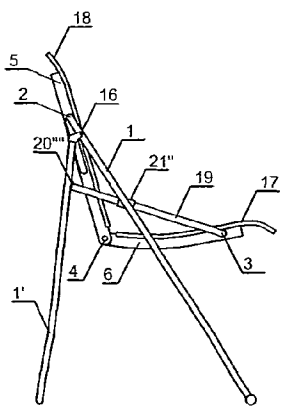
Fig. 37f
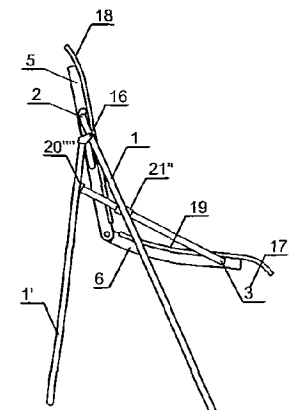
Fig. 37g
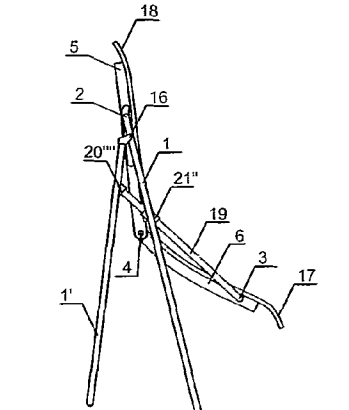
Fig. 37h
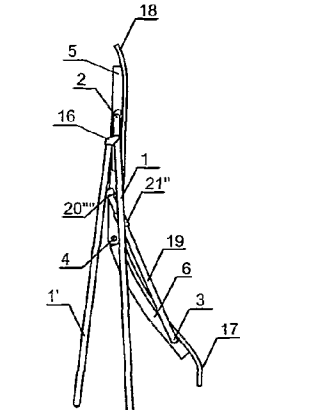
Fig. 37i
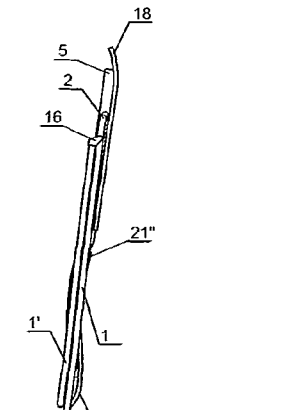
Fig. 37j
Fig. 37

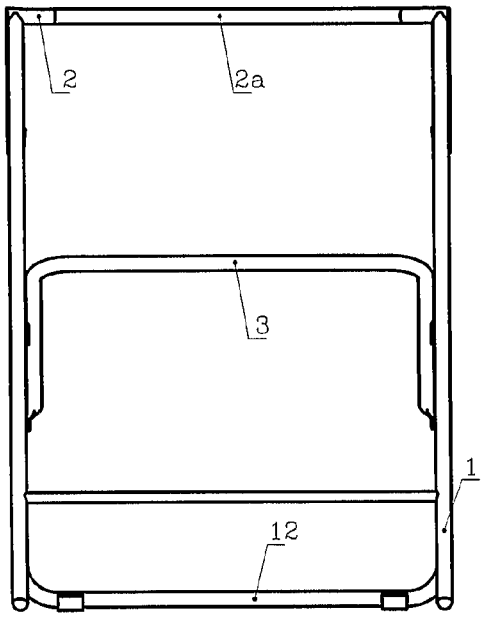
Fig.41a
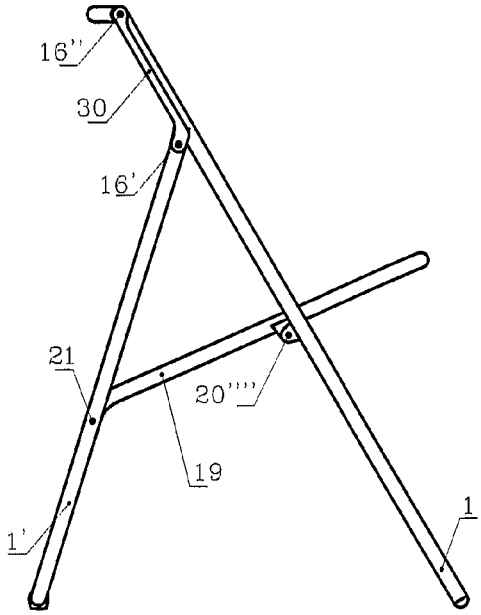
Fig.41b
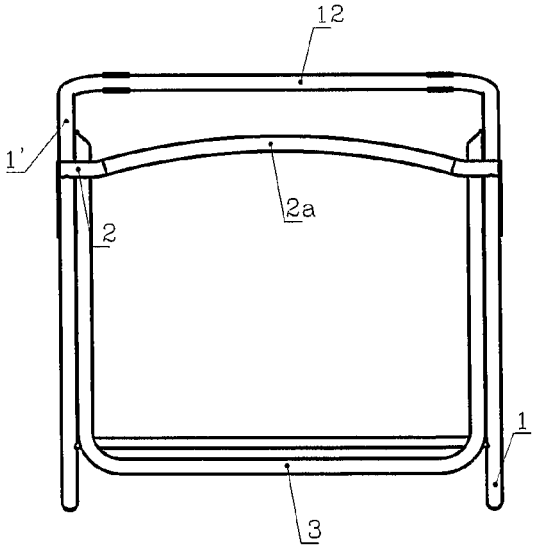
Fig.41c
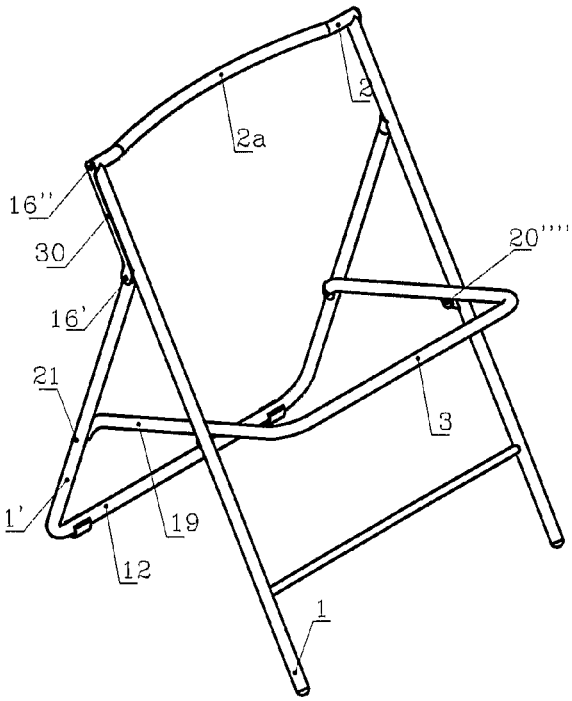
Fig.41d
Fig.41

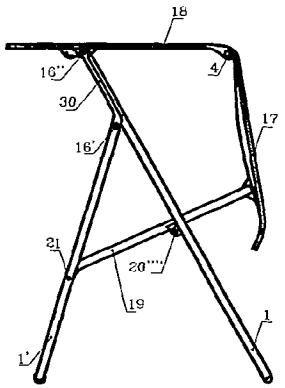
Fig.42a
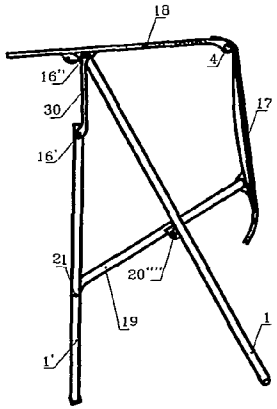
Fig.42b
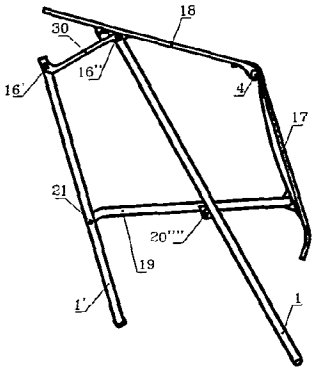
Fig.42c
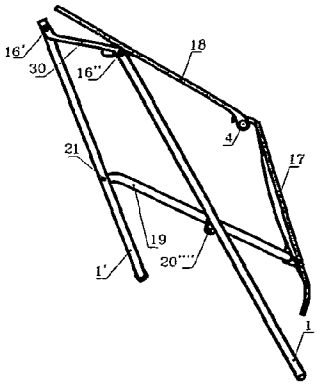
Fig.42d
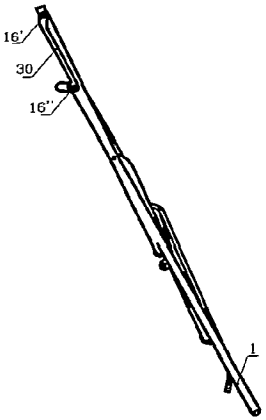
Fig.42e
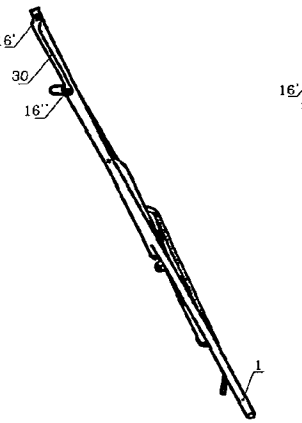
Fig.42f
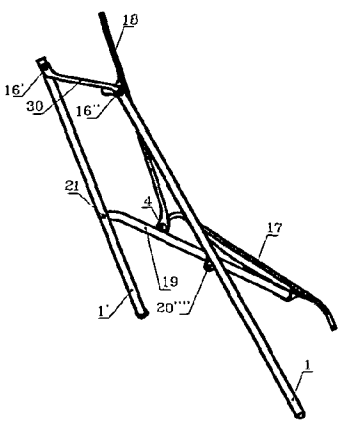
Fig.42g
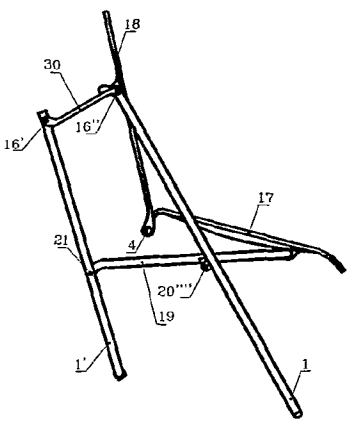
Fig.42h
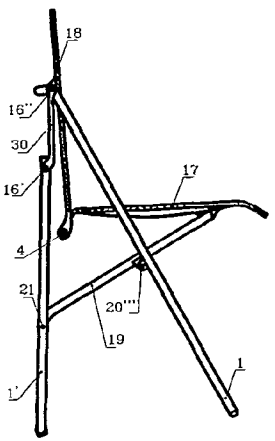
Fig.42i
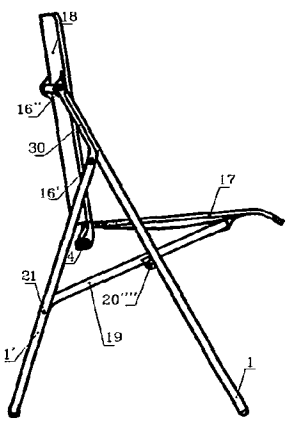
Fig.42j
Fig.42

ITEM OF TRANSFORMABLE FURNITURE

FIELD OF THE INVENTION

The invention relates to an item of transformable furniture, more particularly to an item of furniture transformable from a chair into a desk and vice versa. The item of transformable furniture finds application in the furnishing of conference rooms, offices, training rooms, living quarters, recreation areas.

STATE OF THE ART

Patent application PCT/IB03/00158 of 23.01.2003, publication WO 2004/019730 A1 discloses an item of transformable furniture which consists of two plates, connected by a hinge joint, and a supporting construction consisting of two vertical frames, located parallel to each other and linked by two parallel axes, located at different heights in the space enclosed between the frames. The two plates are located in the space between the frames so that each plate is connected to the frames by means of the first and second axes, in a way ensuring movement of the plates simultaneously with respect to each other and with respect to the axes, which connect the frames, from position "chair" to position "table". In the transformation of the item of furniture from position "chair" to position "table" the first plate performs the function of a seat/worktop, respectively, and the second plate—of a back/front panel, respectively.

Publication of a Bulgarian registration of industrial design No 5140 in Bulletin No 6 of 30.06.2004 makes known an item of transformable furniture which comprises a first and a second plate, connected by a hinge joint, and a supporting construction consisting of two vertical parallel elements, linked by two horizontal parallel axes. A flat element is attached to each plate, serving as a seat/back, respectively. The plates are connected to the supporting construction by means of the first and second horizontal axes of the supporting construction so that they can rotate round the respective axes, being able to move between a first position of a seat and back and a second position of front panel and worktop and vice versa.

Publication of a Bulgarian registration of industrial design No 5141 in Bulletin No 6 of 30.06.2004 makes known an item of folding transformable furniture which comprises a first and a second plate, connected by a hinge joint, and a supporting construction consisting of two closed frames, connected by a hinge joint. A flat element is attached to each plate, serving as a seat/back, respectively. The plates are linked by means of the first and second horizontal axes of the supporting construction. The axes are the upper parts of each of the two closed frames. The plates together with the flat elements can rotate round the respective axes of the supporting construction, being able to move between a first position of a seat and back and a second position of front panel and worktop.

Patent application BG No 108080 of 08.08.2003, published in Bulletin No 4 of 30.04.2005 discloses an item of folding transformable furniture which comprises two plates, connected by a hinge joint, and a folding supporting construction consisting of two frames, connected by a hinge joint, where the two plates are located in the space between the frames, where each of the plates is attached to one of the two frames. This application does not offer a solution providing reliable fixing and locking, respectively unlocking of the folding supporting construction, which would improve the stability of the furniture construction as a whole.

Dutch patent application No 1022740 of 20.02.2003, published on 23.08.2004 in Bulletin No. 10/2004, discloses an item of transformable furniture which comprises two plates, connected by a hinge joint, and a supporting construction. The supporting construction is not folding. The supporting construction does not participate in the transformation from chair into table and vice versa, therefore the item of furniture has limited functions, for example it cannot be stacked.

The aim of the invention is to provide a functionally improved, and at the same time easiest to use, construction of an item of transformable furniture. This aim is achieved by a combination of features formulated in each of the independent claims. Embodiments of the invention of particular advantages are formulated in the dependent claims.

SUMMARY OF THE INVENTION

According to a first aspect of the invention, this aim is achieved by an item of transformable furniture which comprises a first plate and a second plate, linked to each other by a hinge joint, where said two plates can rotate respectively round the first and second horizontal axes so that the plates can be moved from a first position as seat and back, respectively, to a second position as front panel and worktop, respectively, and vice versa. Said plates are linked by said first and second horizontal axes, respectively, to a supporting construction which consists of at least three interconnected folding elements. The use of at least three elements allows a more precise fixing of the folding supporting construction.

In a possible embodiment of the invention, said supporting construction consists of three interconnected folding elements, linked to each other by hinge joints, where at least one of the hinge joints can slide with respect to the interconnected folding elements.

In another embodiment of the invention, the folding elements are in the form of frames, where at least one of the folding elements may be in the form of a closed quadrangular frame, while the other two elements are in the form of open frames bent in rectangular shape, where the middle parts of the said frames form the first and second horizontal axes, a third element being connected to the two interconnected folding elements by means of two couples of hinge joints.

In a further embodiment of the invention, there is a locking mechanism at one of the hinge joints.

In another embodiment of the invention, the plate serving as back or worktop is joined to one of the said folding elements so that when said elements are folded the plate is deformable depending on its concrete position from a substantially bent form as back to a substantially flat form as worktop and vice versa.

In a further embodiment of the invention, said first axis is in the form of an elongated, preferably cylindrical, bent element, lying in a horizontal plane, where the said first plate is made of a flexible flat element connected to the said first axis so that in the position of worktop said bent element provides support for the worktop in the horizontal plane, while in the position of back the said bent element can be pulled in the middle part of said flexible flat element making the flexible flat element take a concave shape, following the shape of the bent element.

In another embodiment of the invention, the item of transformable furniture may contain a locking device to fix the respective position of at least two of said three inwardly or outwardly connected folding elements.

In a further embodiment of the invention, at least one of said axes is slidably connected to the respective plate to enable a change of the positions of the sliding bolt of said plate of said axis, where said position can also be fixed by another locking device.

According to another aspect of the invention, the aim of the invention is achieved by an item of transformable furniture that comprises a first plate and a second plate, connected to each other by a hinge joint, where said two plates can rotate respectively round first and second horizontal axes so that the plates can be moved from a first position as seat and back, respectively, to a second position as front panel and worktop, respectively, where the first plate, serving as back and worktop, is deformable depending on its concrete position from a substantially bent/concave form as back to a substantially flat form as worktop and vice versa.

According to a preferred embodiment of the item of transformable furniture, the plate serves as back or worktop and the same is attached to one of the said folding elements so that when said elements are folded it is deformable depending on its concrete position from a substantially bent form as back to a substantially flat form as worktop and vice versa.

According to a further embodiment of the item of transformable furniture, said first axis is formed as an elongated, preferably cylindrical element with a bent section, lying in a horizontal plane, and said first plate, made of a flexible flat element is attached to this section so that it can rotate, so that in the position of worktop said bent section serves as three-point support, supporting the worktop in a plane, while in the position of back said bent section pulls the flexible element that touches the ends of the elongated element, shaping it so that the flexible element takes a concave shape, following the shape of said bent section.

According to another embodiment, the item of transformable furniture in addition contains a locking device to fix in the respective relative position at least two of said three connected and folding elements.

According to a further embodiment of the item of transformable furniture, at least one of the said axes is attached to the respective plate so that it can slide and move the position of the point of rotation of said plate with respect to said axis, where said position can be fixed by means of another locking device.

According to a preferred embodiment, the item of transformable furniture, comprising a first plate and a second plate connected to each other by a hinge joint, where said two plates can rotate respectively round first and second horizontal axes so that the plates can be moved from a first position as seat and back, respectively, to a second position as front panel and worktop, respectively, where the first plate, serving as back and worktop, is deformable depending on its concrete position from a substantially concave form as back to a substantially flat form as worktop and vice versa.

According to a further embodiment of the item of transformable furniture, said first axis is formed as an elongated, preferably cylindrical element with a bent section, lying in a horizontal plane, and said first plate, made of a flexible flat element is attached to this section so that it can rotate, so that in the position of worktop said bent section serves as three-point support, supporting the worktop in a plane, while in the position of back said bent section pulls the flexible element, shaping it so that the flexible element takes a concave shape, following the shape of said bent section.

According to another embodiment of the item of transformable furniture, said first plate has inhomogeneous (irregular) ability of deformation.

According to a further embodiment of the item of transformable furniture, one of the couples of joints is capable either of rotation and translation or of rotation only, while the other couple of joints is capable of rotation or translation, and vice versa.

According to a further embodiment of the item of transformable furniture, the fixing device is a locking mechanism consisting of a slot, locking element and spring or a T-shaped slipping bush, peg, spring and button.

According to a preferred embodiment of the item of transformable furniture, the couple of slots are formed longitudinally in the long sides of one of the frames, and at one end the slots end in a circular opening, while at the opposite end they end in a curve, formed as an arc-shaped cutout providing for bayonet locking/respectively unlocking of the supporting construction in unfolded/respectively folded position.

According to a further embodiment of the item of transformable furniture, the couple of T-shaped slipping bushes are located at the long sides of one of the frames and can move along the long sides of the respective frame, and together with the peg, spring and button provide locking/respectively unlocking of the supporting construction in unfolded/respectively folded position.

According to another embodiment, the item of transformable furniture comprises a seat and a back, connected by a hinge joint. Said seat and back can rotate respectively round first horizontal axis and second horizontal axis so that the seat and back can be moved from a first position as seat and back, respectively, to a second position as front panel and worktop, respectively, and vice versa. The seat and back are attached to a supporting construction by means of said first and second horizontal axes. The supporting construction consists of at least three interconnected folding elements. At least two of the folding elements are connected by hinge joints with a coupling element. The coupling element is a flat element, more particularly plate, which is fixed at the upper end of at least of the two folding elements. The coupling element can rotate up to 180° round the respective hinge joint.

DESCRIPTION OF THE FIGURES

FIG. 3 shows different views of the supporting construction of the chair in FIG. 1.

FIG. 3*a* is a front view of the supporting construction of the chair.

FIG. 3*b* is a side view of the supporting construction of the chair.

FIG. 3*c* is a top view of the supporting construction of the chair.

FIG. 3*d* is a perspective view of the supporting construction of the chair.

FIG. 9 shows different views of the supporting construction of the chair in FIG. 7.

FIG. 9*a* is a front view of the supporting construction of the chair.

FIG. 9*b* is a side view of the supporting construction of the chair.

FIG. 9*c* is a top view of the supporting construction of the chair.

FIG. 9*d* is a perspective view of the supporting construction of the chair.

FIG. 21 shows different views of the supporting construction of the folding item of transformable furniture—chair in FIG. 19, according to the invention.

FIG. 22 is side view of chair according to the invention, showing the transformation from chair to desk (FIGS. 22*a*-22*j*).

FIG. 26 shows different views of the supporting construction of the transformable chair to desk (FIGS. 26*a*-26*d*).

FIG. 27 is side view of chair according to the invention, showing the transformation from chair to desk (FIGS. 27*a*-27*j*).

FIG. 31 shows different views of the supporting construction of the transformable chair to desk (FIGS. 31*a*-31*d*).

FIG. 32 is side view of chair according to the invention, showing the transformation from chair to desk (FIGS. 32*a*-32*j*).

FIG. 36 is a drawing of the supporting construction of a version of the folding item of transformable furniture—chair, according to the invention.

FIG. 37 is side view of chair according to the invention, showing the transformation from chair to desk (FIGS. 37*a*-37*j*).

FIG. 41 is a drawing of the supporting construction of a version of the folding item of transformable furniture—chair, according to the invention.

FIG. 42 is side view of chair according to the invention, showing the transformation from chair to desk (FIGS. 42*a*-42*j*).

DETAILED DESCRIPTION OF THE PREFERRED EMBODIMENTS

Figure 1:
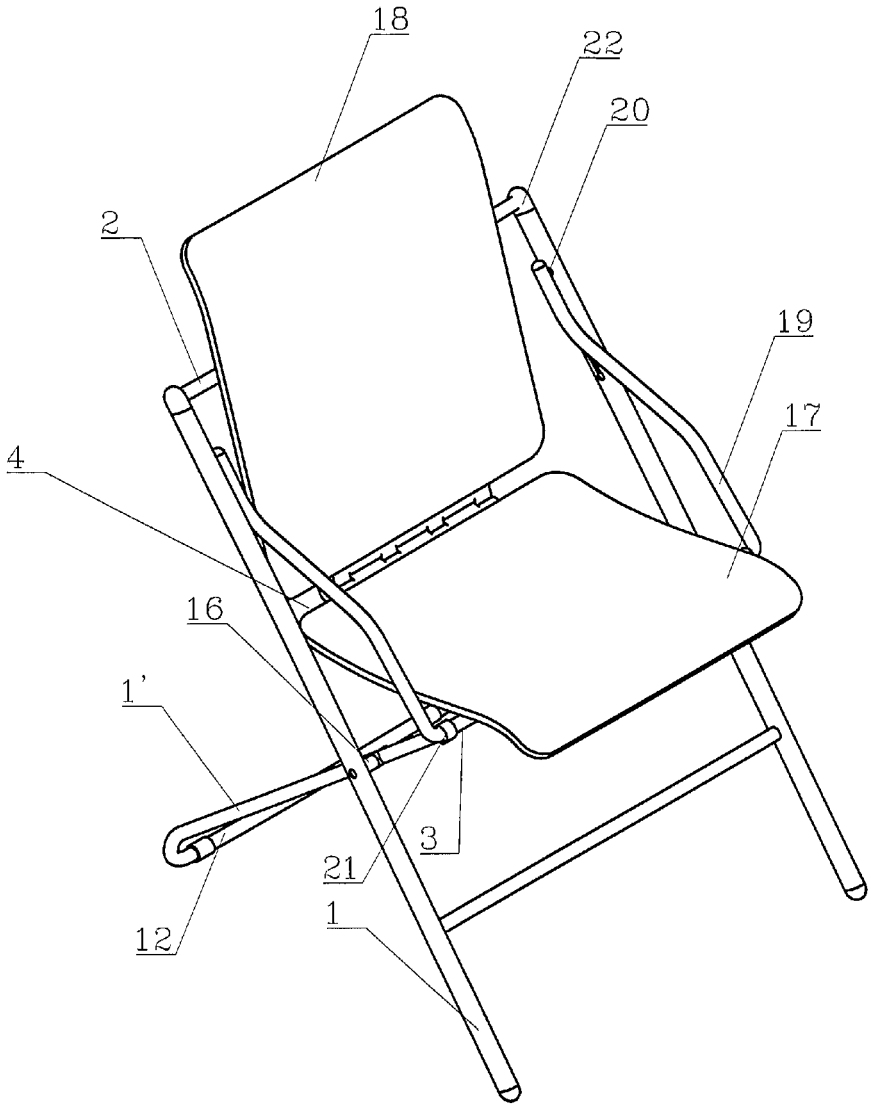
FIG. 1 is a perspective view of one version of the item of transformable furniture—chair, according to the invention.
Figure 2:
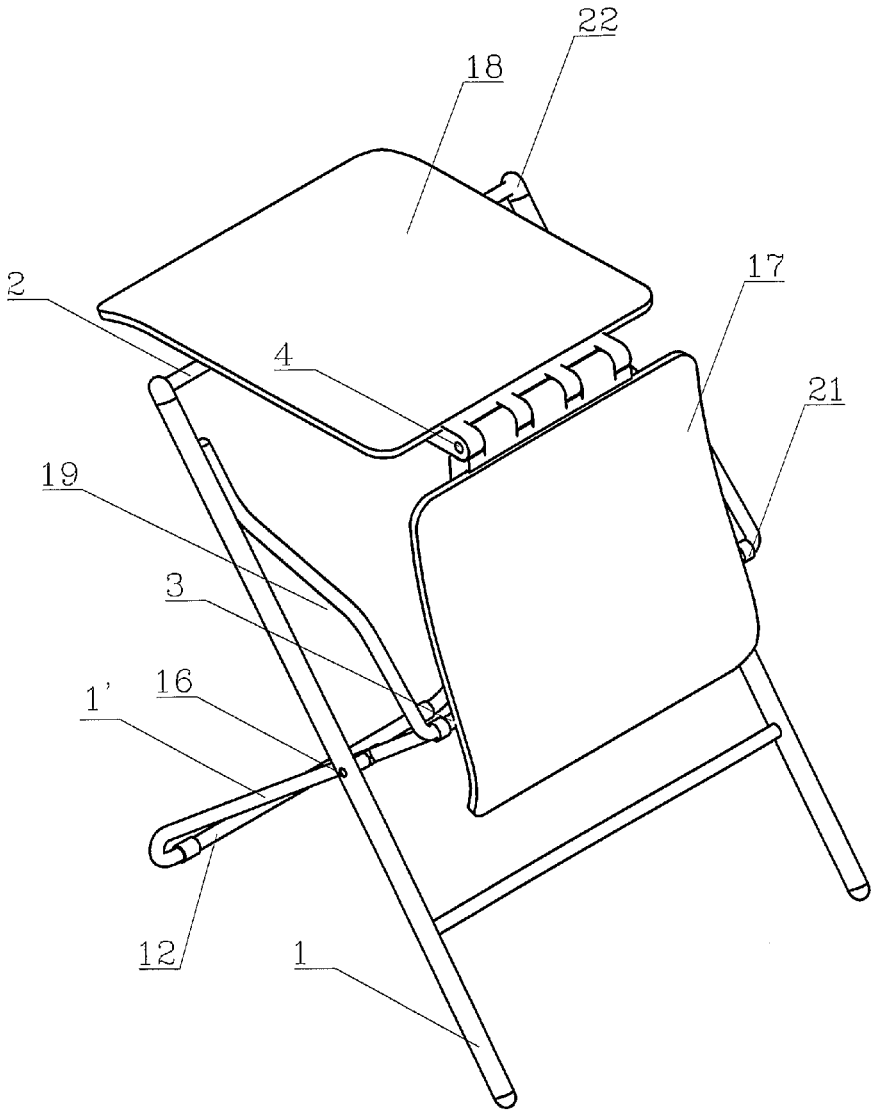
FIG. 2 is a perspective view of the item of furniture—chair in FIG. 1, transformed into a desk.
Figure 4:
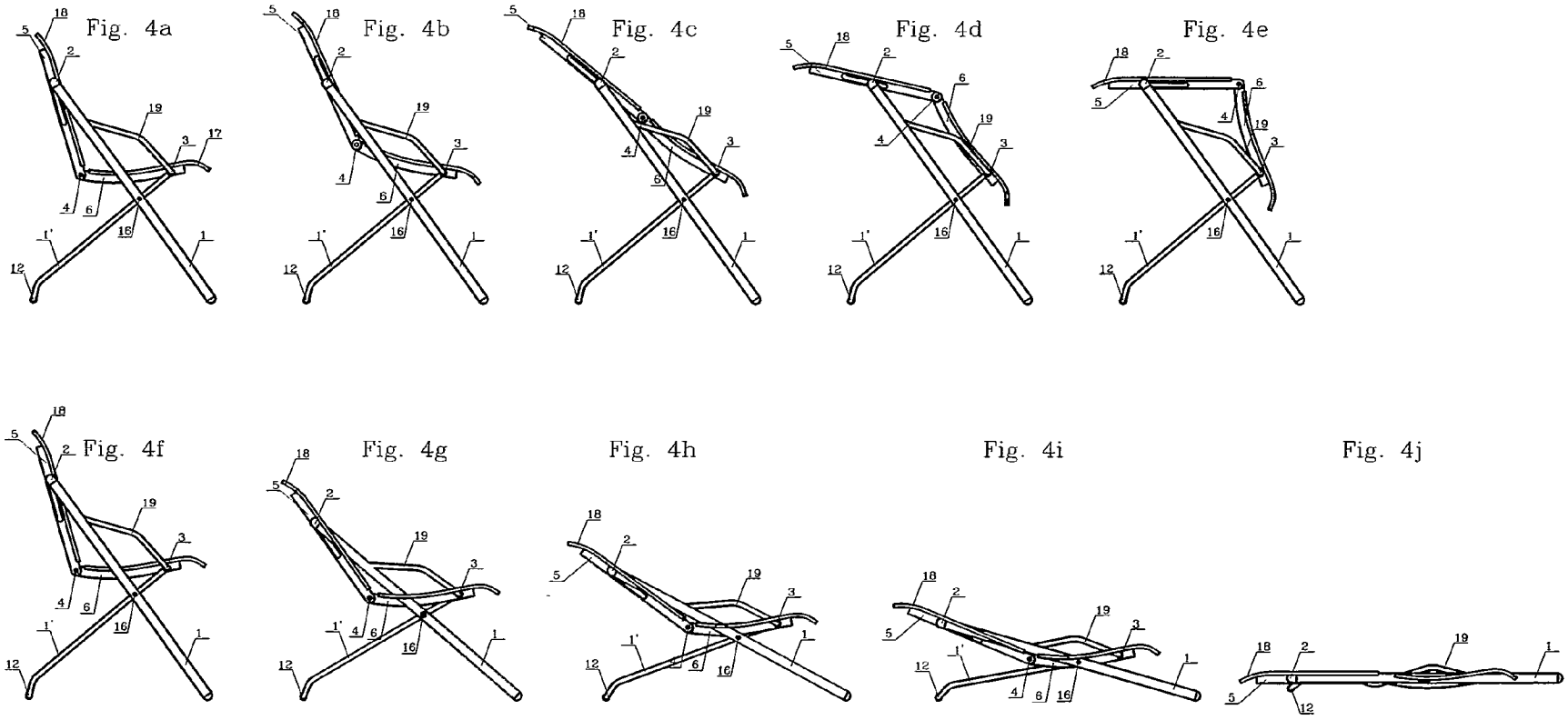
FIG. 4 is side view of chair according to the invention, showing the transformation from chair to desk (FIGS. 4*a*-4*j*).
Figure 5:
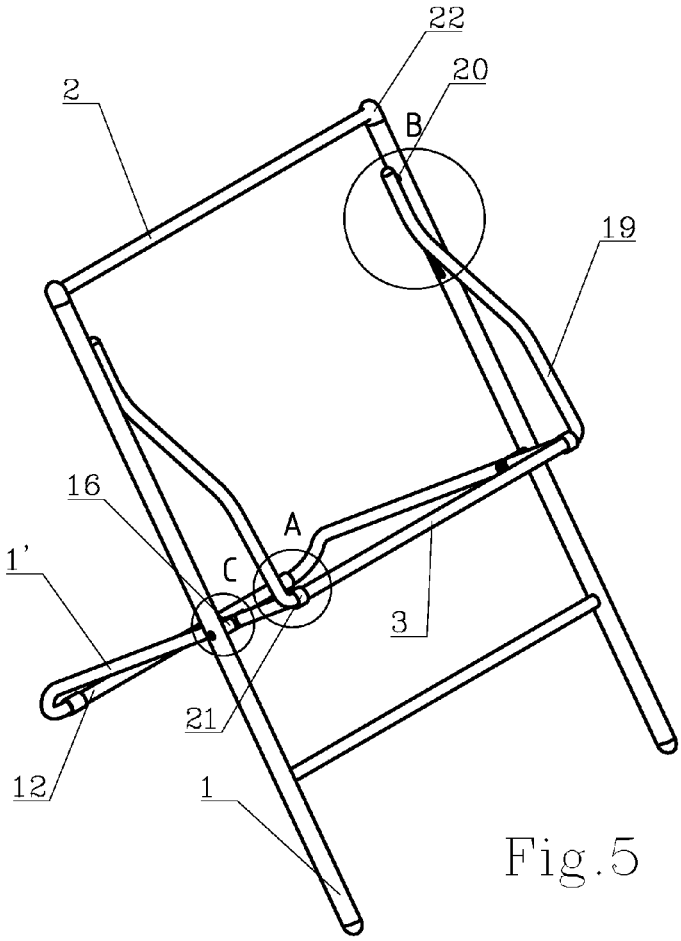
FIG. 5 is a perspective view of the supporting construction of the item of transformable furniture—chair, according to the invention.
Figure 5A:
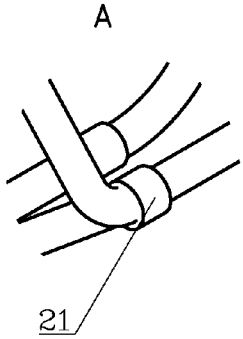
Figure 5B:
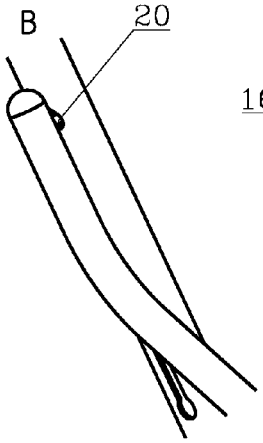
Figure 5C:
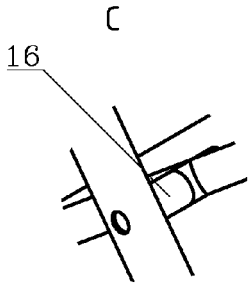
Figure 6:
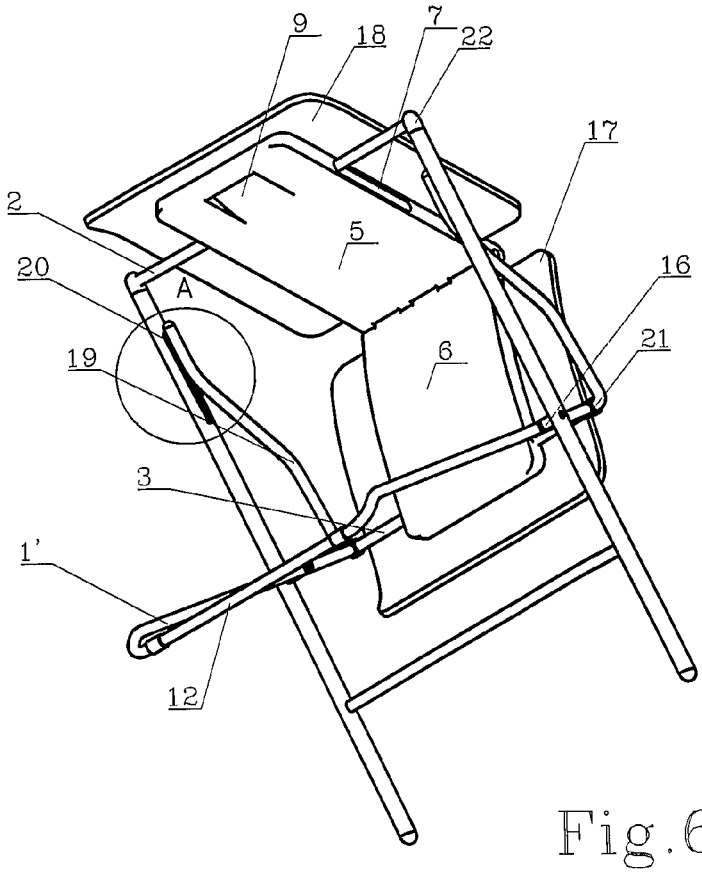
FIG. 6 is a perspective view from below of the item of transformable furniture—desk, according to the invention.
Figure 6A:
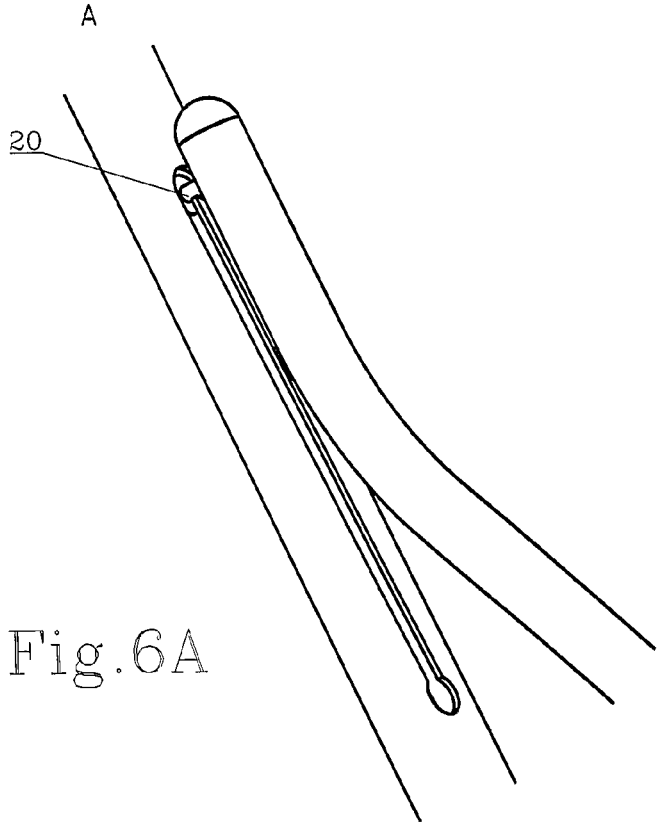

According to a first embodiment of the invention, shown in FIG. 1-6, the item of transformable furniture consists of two substantially flat elements 17, 18 with attached plates 6, 5 by means of which the flat elements 17, 18 are connected by a hinge joint 4. The flat elements 17, 18 are not located in a plane but are bent in an ergonomic shape, shown in the figures, and can rotate round a first and a second horizontal axes 2, 3, respectively. In this first embodiment the two axes consist of the straight horizontal sections 2, 3 of two of the folding elements, embodied as tubular frames 1, 19 as best shown in FIG. 1-6. The axis 2 passes through slot 7 formed in the plate 5 attached to the first plate 18. The slot 7 allows translation and rotation movement round axis 2. The supporting construction consists of three tubular frames 1, 1', 19. In this way in unfolded position of the supporting construction the two flat elements 17, 18 can be moved between a first position as seat and back and a second position as front panel and worktop, as shown in FIG. 4*a* to 4*e*. By means of the axes 2, 3 the flat elements 17, 18 are attached to the supporting construction, which besides the two frames 1, 19 includes at least one more third frame 1' linked to them. Frame 19 is linked to the frames 1, 1' by two couples of hinge joints 20 and 21. The long sides of frame 1 are made of flat oval tube, while the other sides of the frame and frames 1' and 19 are made of round tube. Frame 19 in the position "chair" performs the function of armrest. The locking mechanism of the supporting construction located at hinge joint 20 consists of a couple of slots, locking elements, and springs. The slots are formed longitudinally in the couple of long sides of frame 1. The slots end at their lower ends in a circular opening, while at the opposite ends the slots end in a curve at acute angle, which is formed as an arc-shaped cutout providing for locking of the supporting construction 1, 1', 19 in unfolded position. The locking takes place as the locking element, which is a locking bolt falls in the arc-shaped (bayonet) cutout of the slot, pushed by the spring. The unlocking takes place by applying pressure to the upper ends of frame 19, whereby the action of the spring is overcome. The hinge joint 20, which links frames 1 and 19, provides rotation and translation longitudinally along the two sides of frame 1. The hinge joint 21, which links frames 1' and 19, provides rotation. The hinge joint 16, which links frames 1 and 1', provides rotation.

Figure 7:
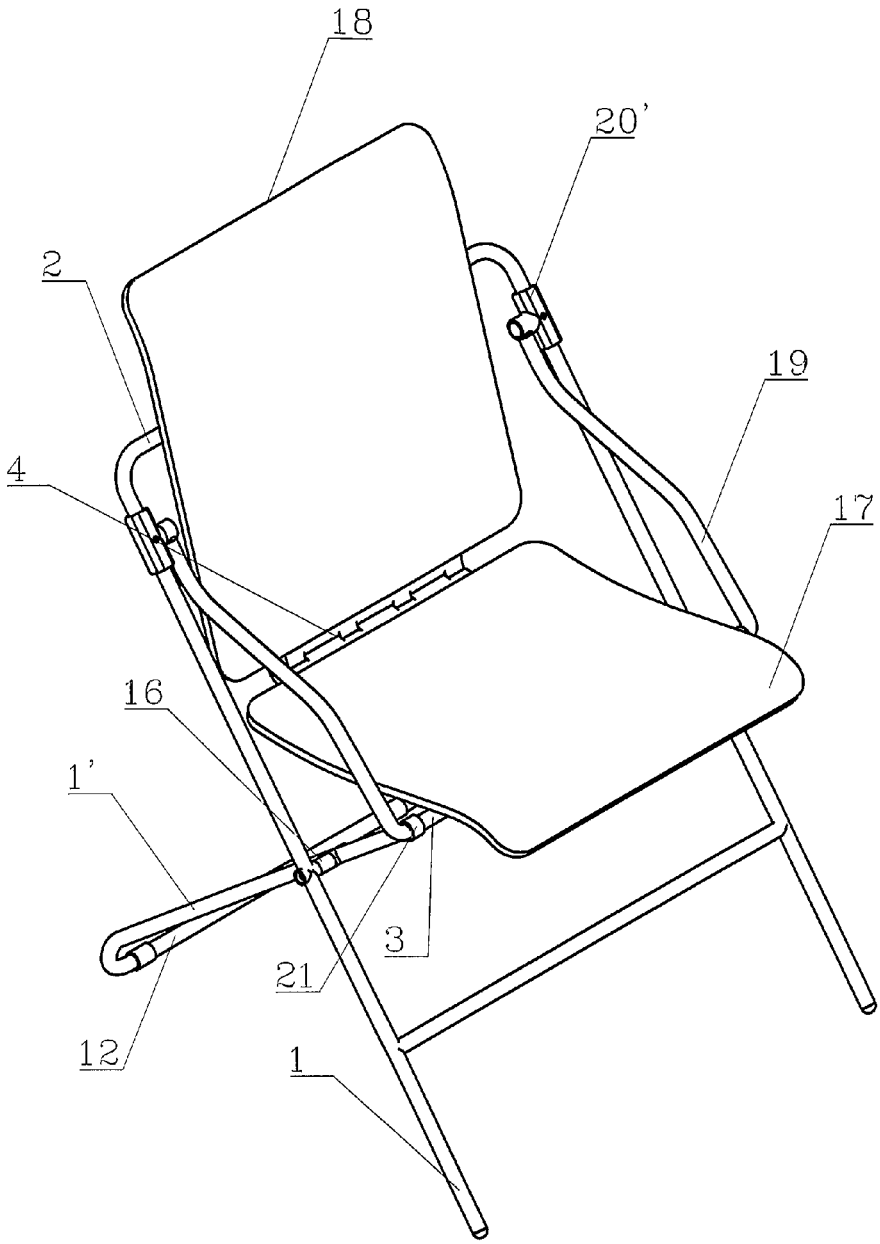
FIG. 7 is a perspective view of another version of the item of transformable furniture—chair.
Figure 8:
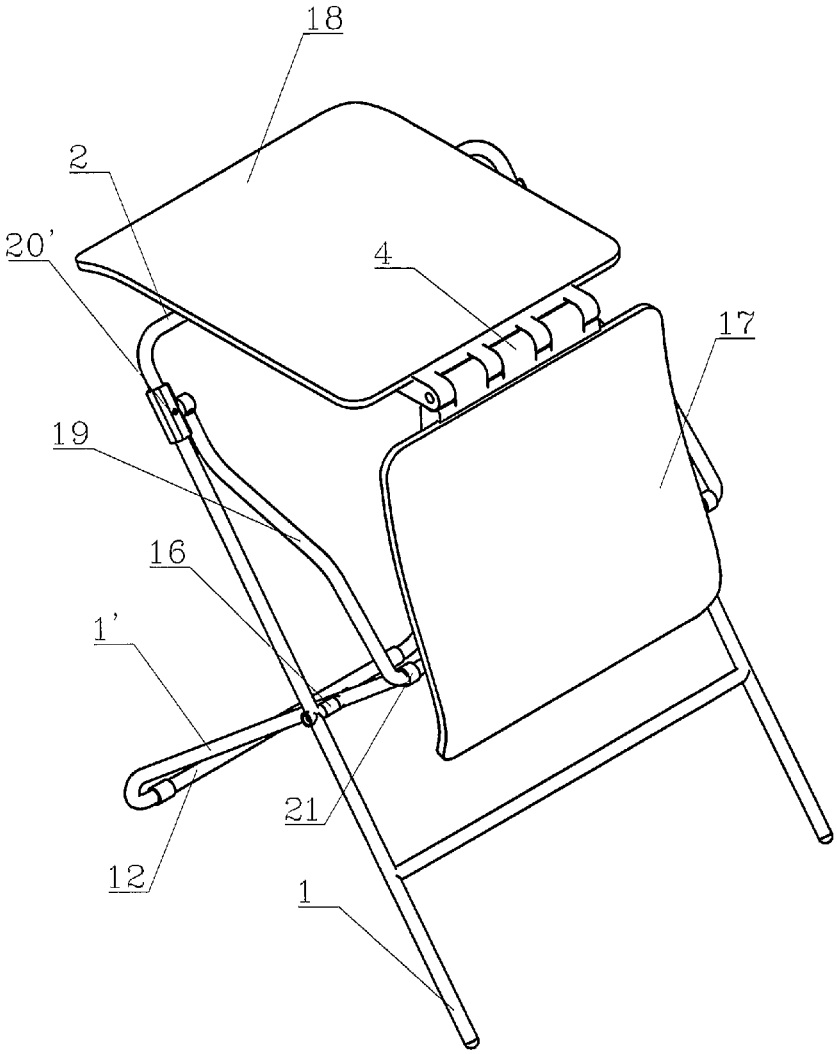
FIG. 8 is a perspective view of the item of furniture—chair in FIG. 7, transformed into a desk.
Figure 10:
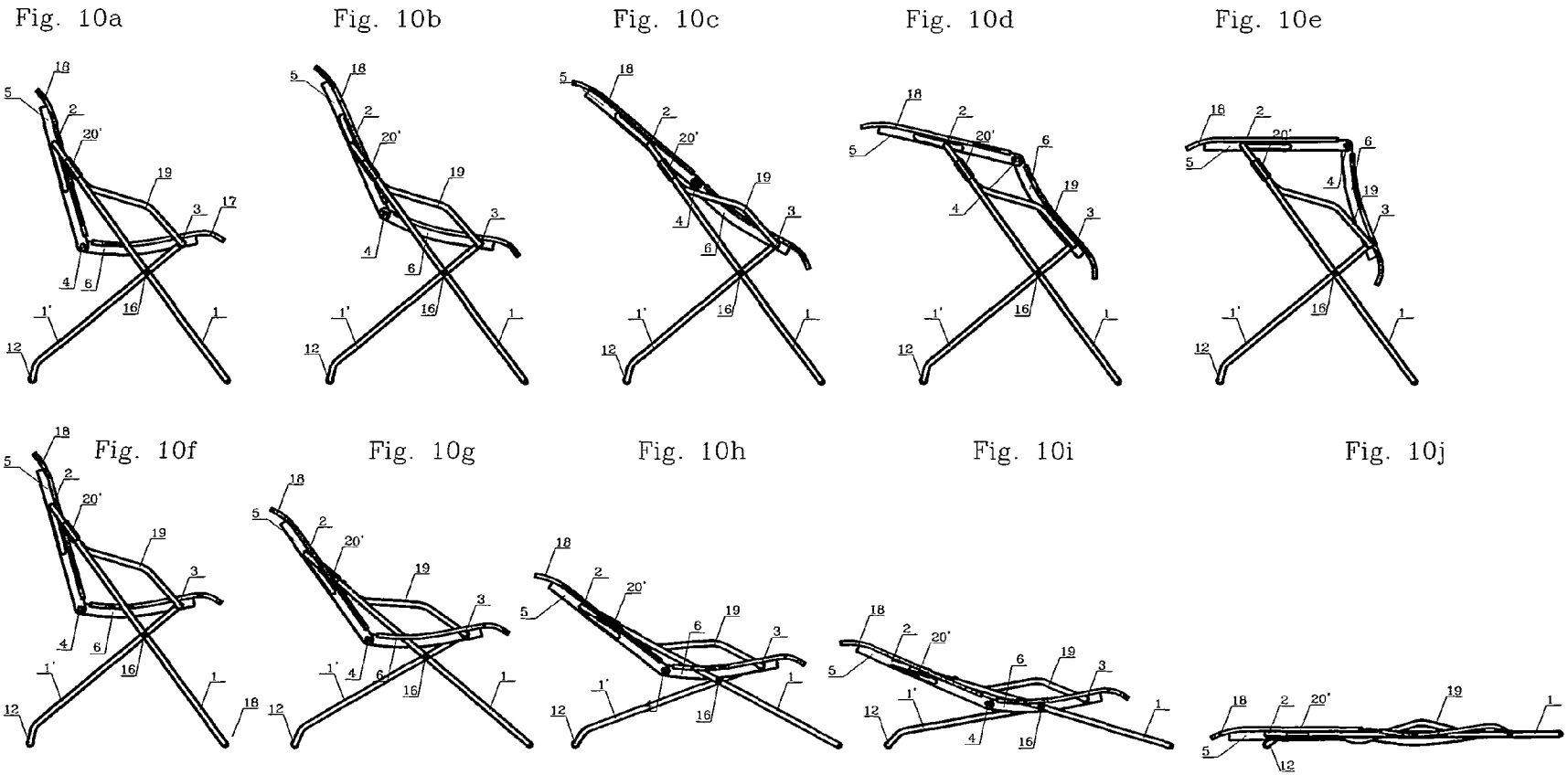
FIG. 10 is side view of chair according to the invention, showing the transformation from chair to desk (FIGS. 10*a*-10*j*).
Figure 11:
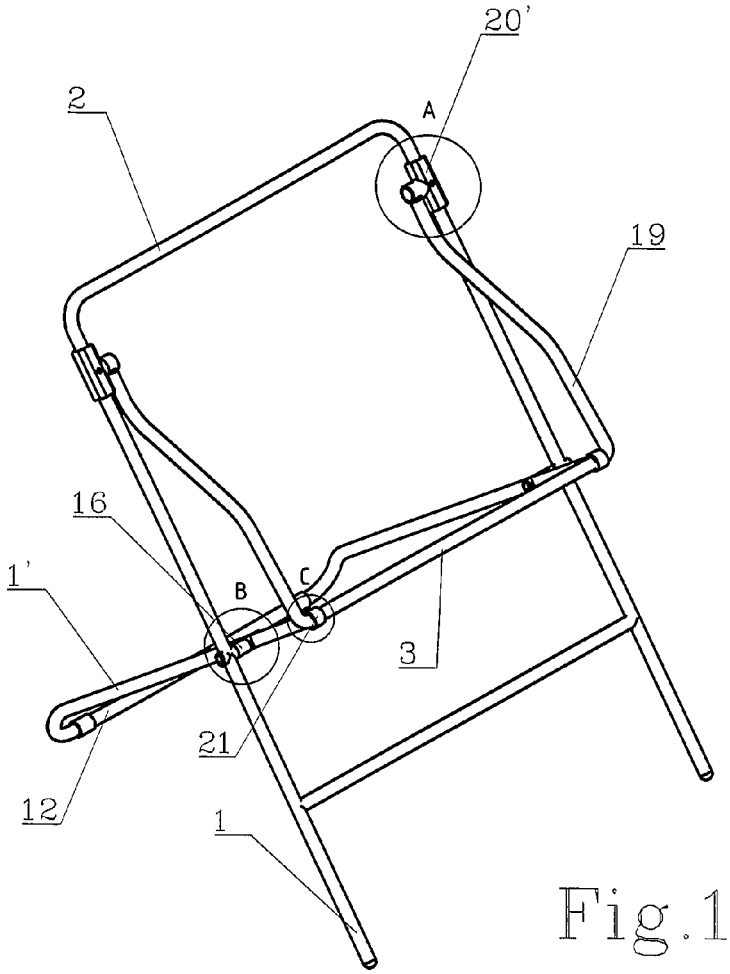
FIG. 11 is a perspective view of the supporting construction of the item of transformable furniture—chair, according to the invention.
Figure 11A:
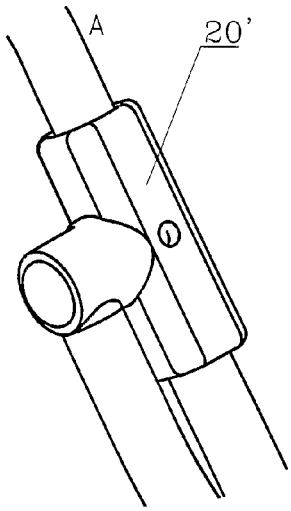
Figure 11B:
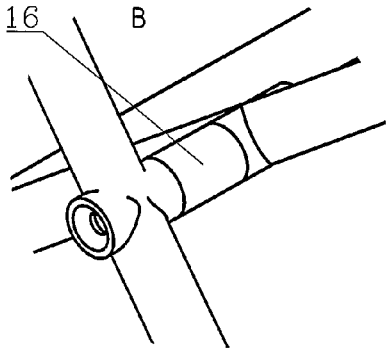
Figure 11C:
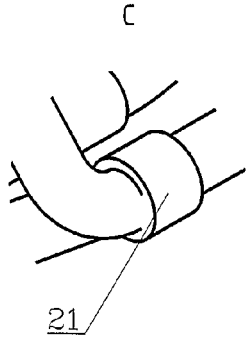
Figure 12:
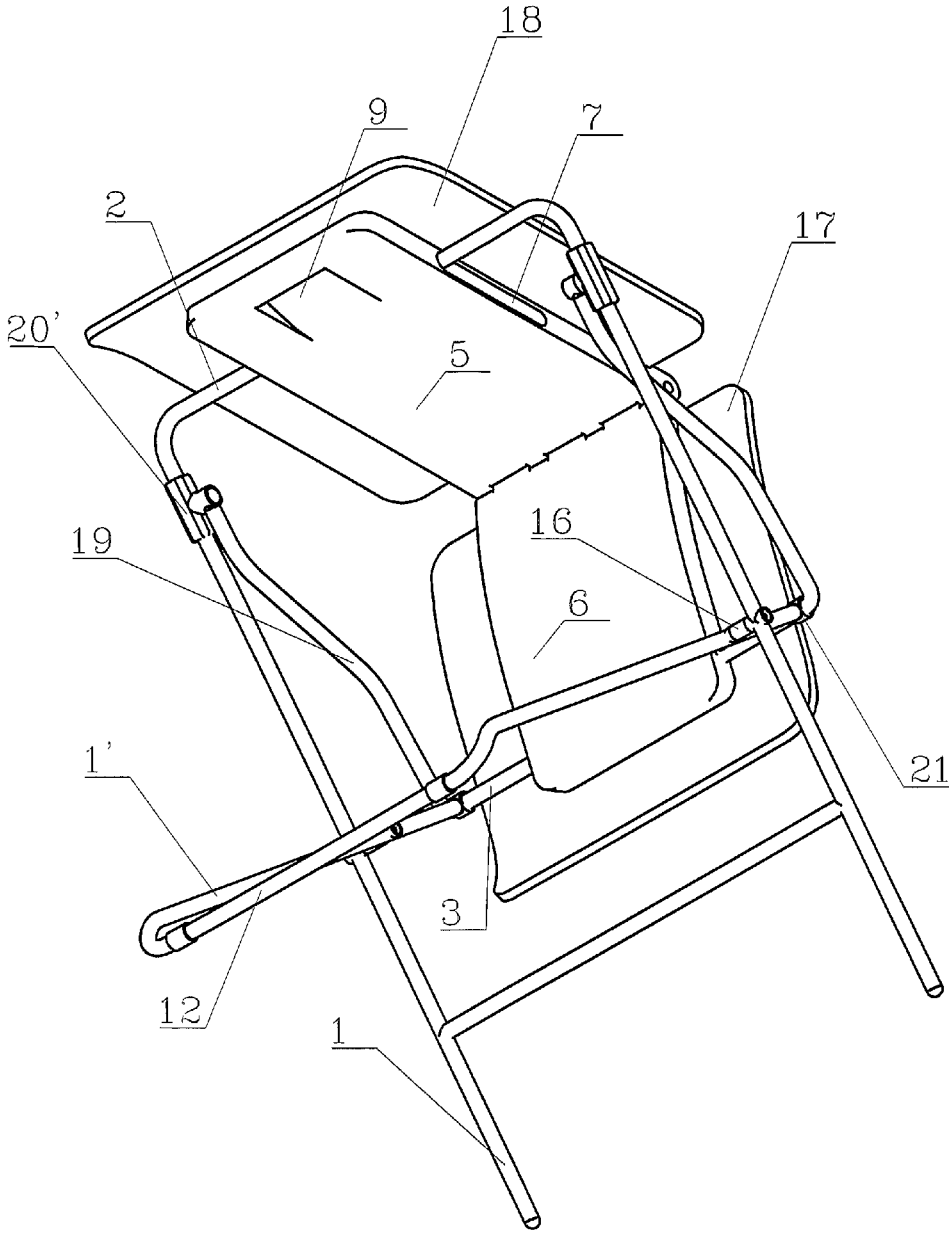
FIG. 12 is a perspective view from below of the item of transformable furniture—desk, according to the invention.

According to a second embodiment of the invention, shown in FIG. 7-12, the item of transformable furniture consists of two substantially flat elements 17, 18 with attached plates 6, 5 by means of which the flat elements 17, 18 are connected by a hinge joint 4. The flat elements 17, 18 are not located in a plane but are bent in an ergonomic shape, shown in the figures, and can rotate round a first and a second horizontal axes 2, 3, respectively. In this embodiment the two axes consist of the straight horizontal sections 2, 3 of two of the folding elements, embodied as tubular frames 1, 19 as best shown in FIG. 1-6. The axis 2 passes through slot 7 formed in the plate 5 attached to the first plate 1S. The slot 7 allows translation and rotation movement round axis 2. The supporting construction consists of three tubular frames 1, 1', 19. In this way in unfolded position of the supporting construction the two flat elements 17, 18 can be moved between a first position as seat and back and a second position as front panel and worktop, as shown in FIG. 10*a* to 10*e*. By means of the axes 2, 3 the flat elements 17, 18 are attached to the supporting construction, which besides the two frames 1, 19 includes at least one more third frame 1' linked to them. Frame 19 is linked to the frames 1, 1' by two couples of hinge joints 20' and 21. The three frames 1, 1', 19 of the supporting construction are made of tubes of circular cross-section. The frame 19 in the position "chair" performs the function of armrest. The locking mechanism consists of T-shaped slipping bush, peg, spring and button and is located at hinge joint 20' in the long sides of frame 1. The hinge joint 20', which links frames 1 and 19, provides rotation and translation longitudinally along the two sides of frame 1. The hinge joint 21, which links frames 1' and 19, provides rotation. The hinge joint 16, which links frames 1 and 1', provides rotation.

Figure 13:
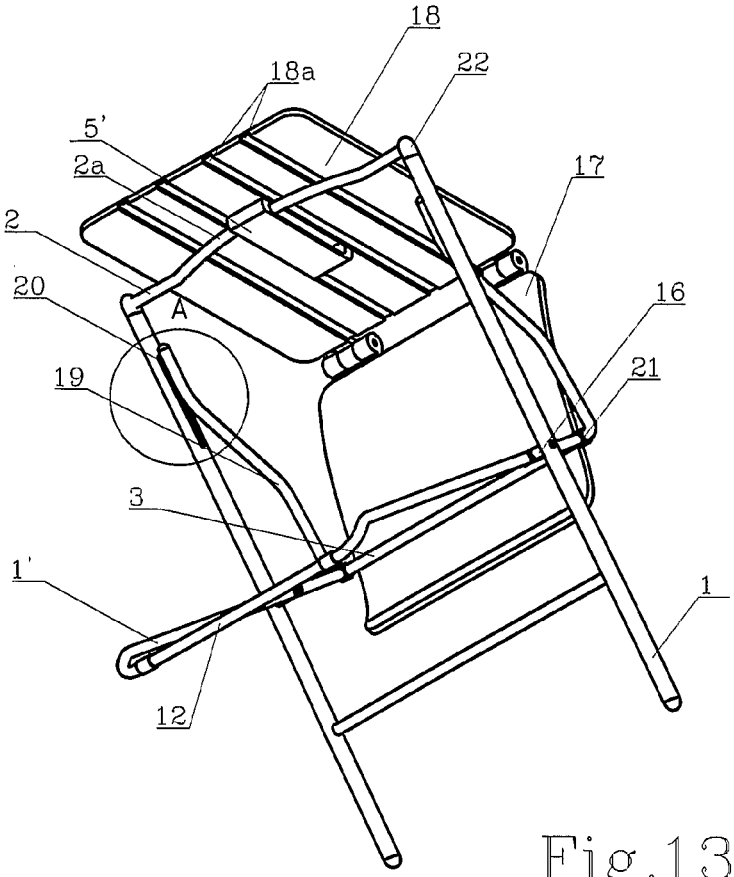
FIG. 13 is a perspective view from below of a further version of the item of transformable furniture in the position of desk, according to the invention.
Figure 13A:
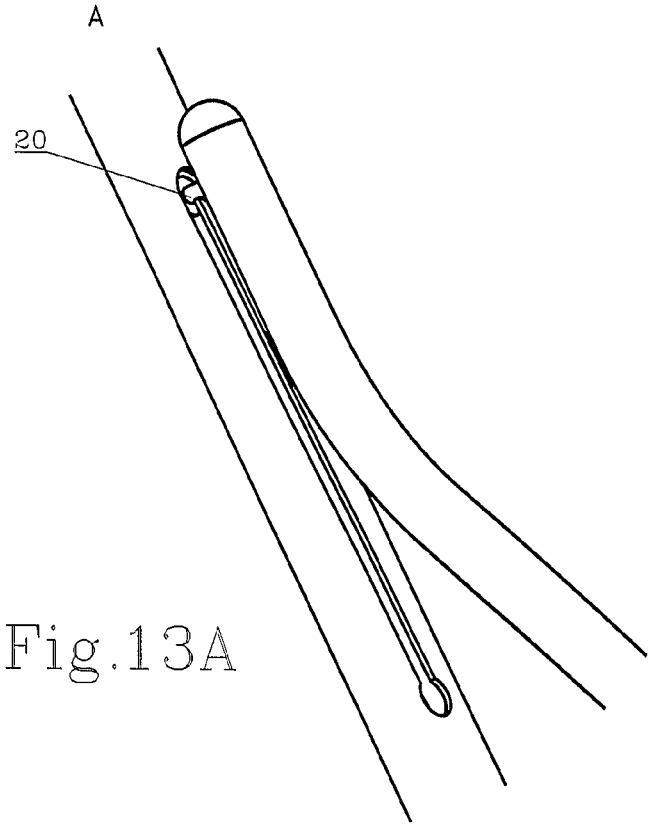
Figure 14:
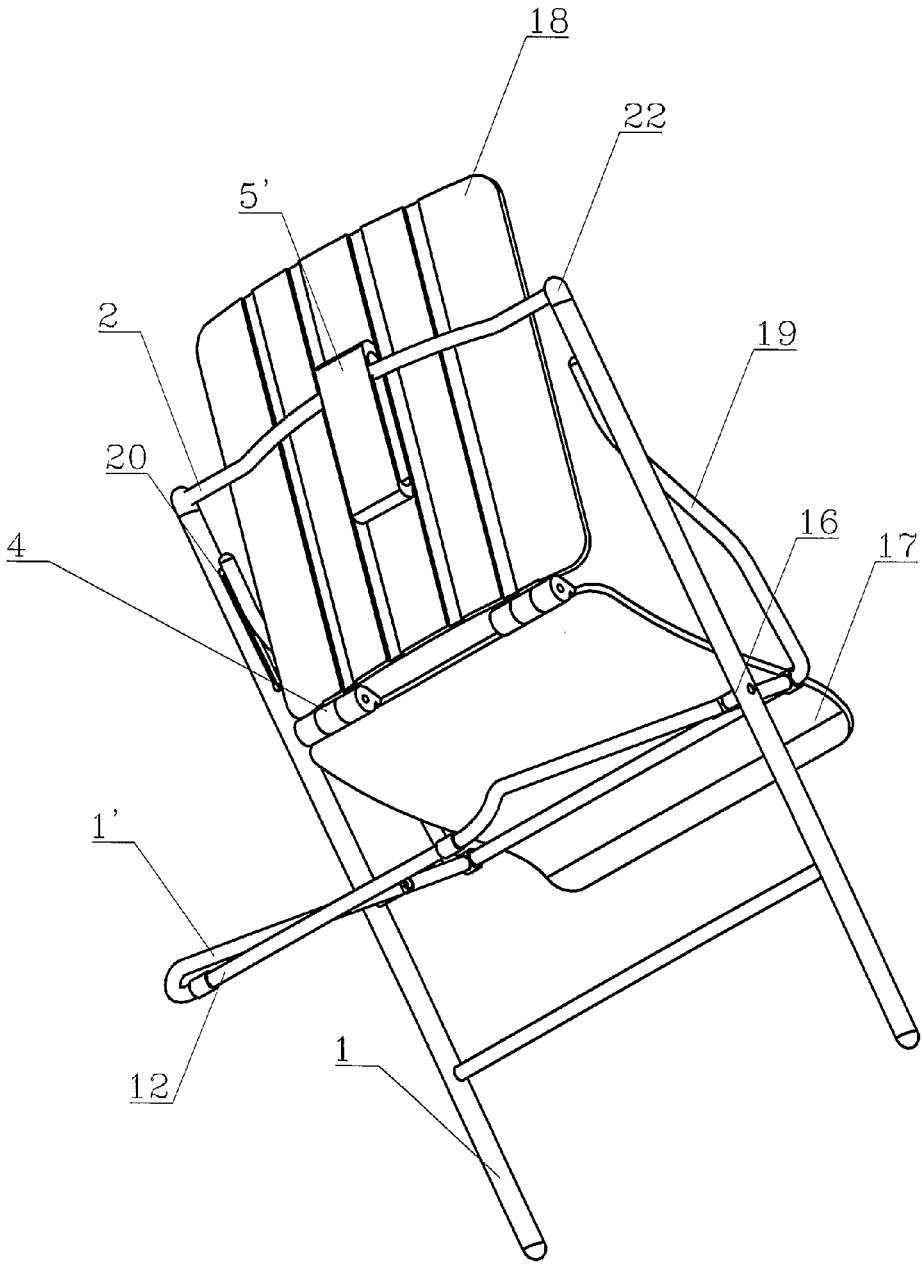
FIG. 14 is a perspective view from below of the item of transformable furniture in FIG. 13 in the position of chair, according to the invention.
Figure 15:
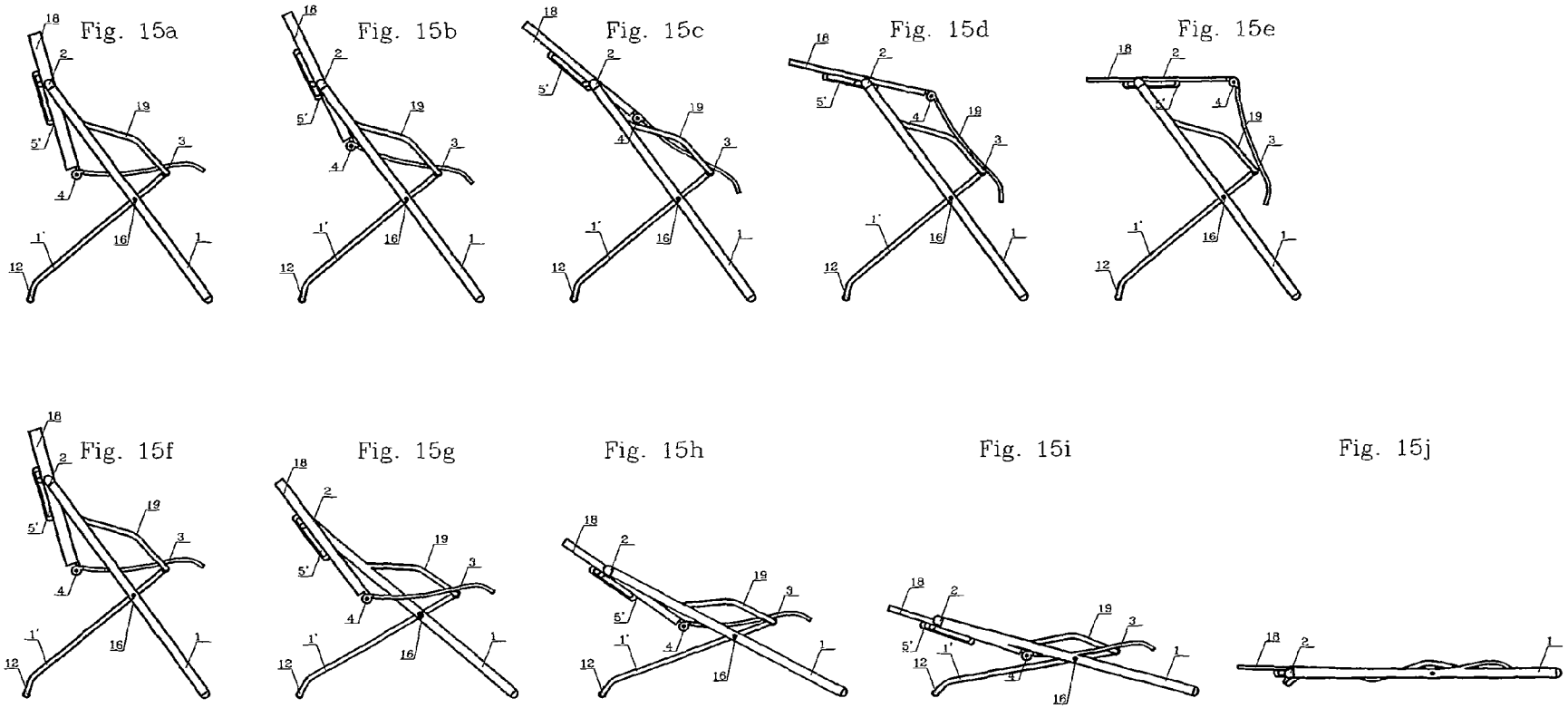
FIG. 15 is side view of chair according to the invention, showing the transformation from chair to desk (FIGS. 15*a*-15*j*).
Figure 16:
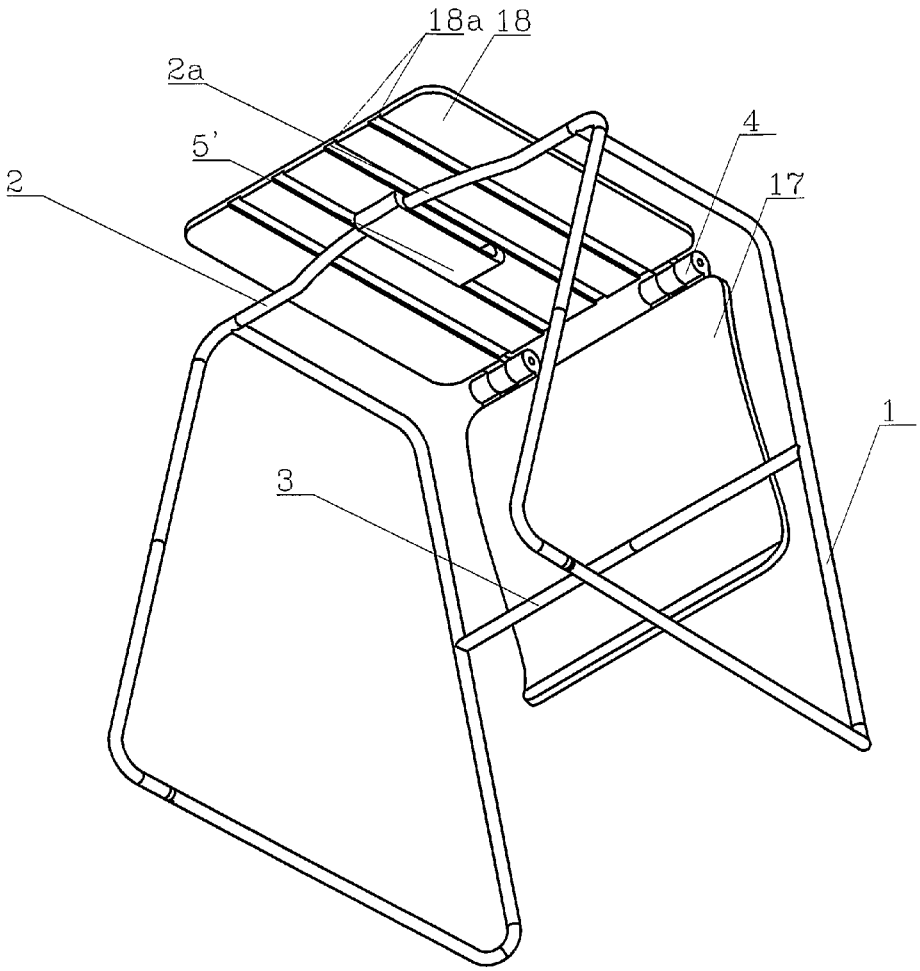
FIG. 16 is a perspective view from below of a further version of the item of transformable furniture in the position of desk, according to the invention.
Figure 17:
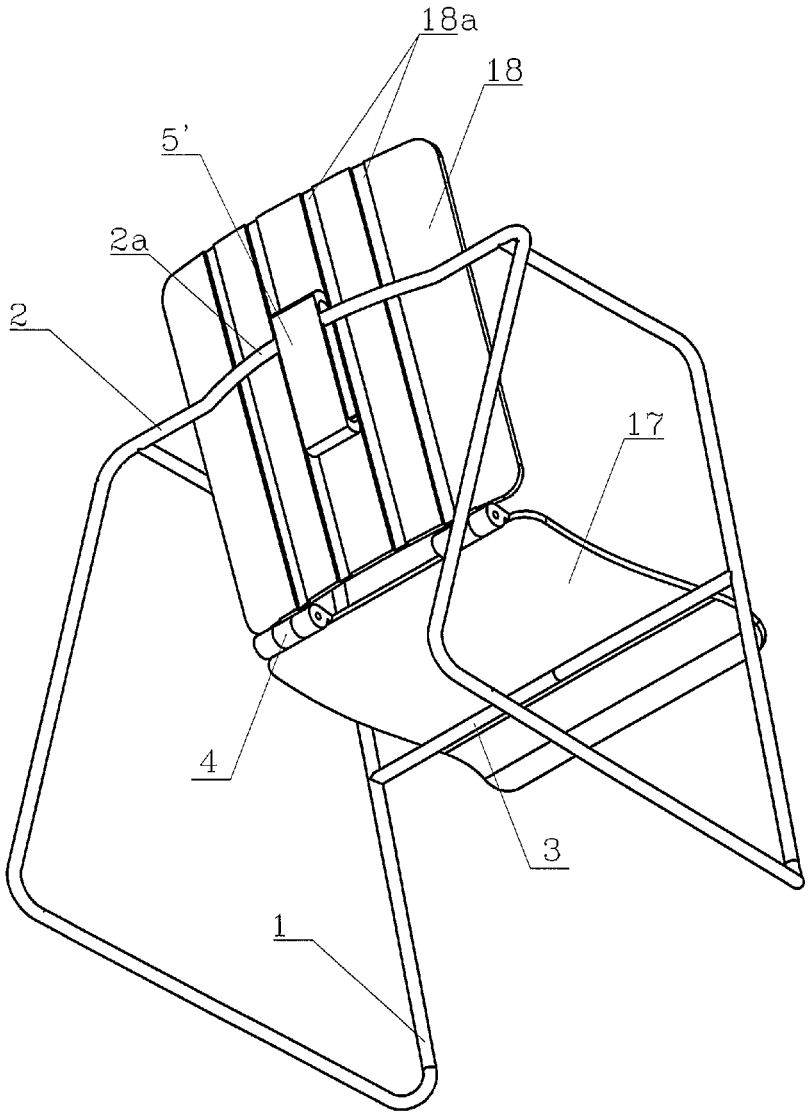
FIG. 17 is a perspective view from below of the item of transformable furniture in FIG. 16 in the position of chair, according to the invention.
Figure 18:
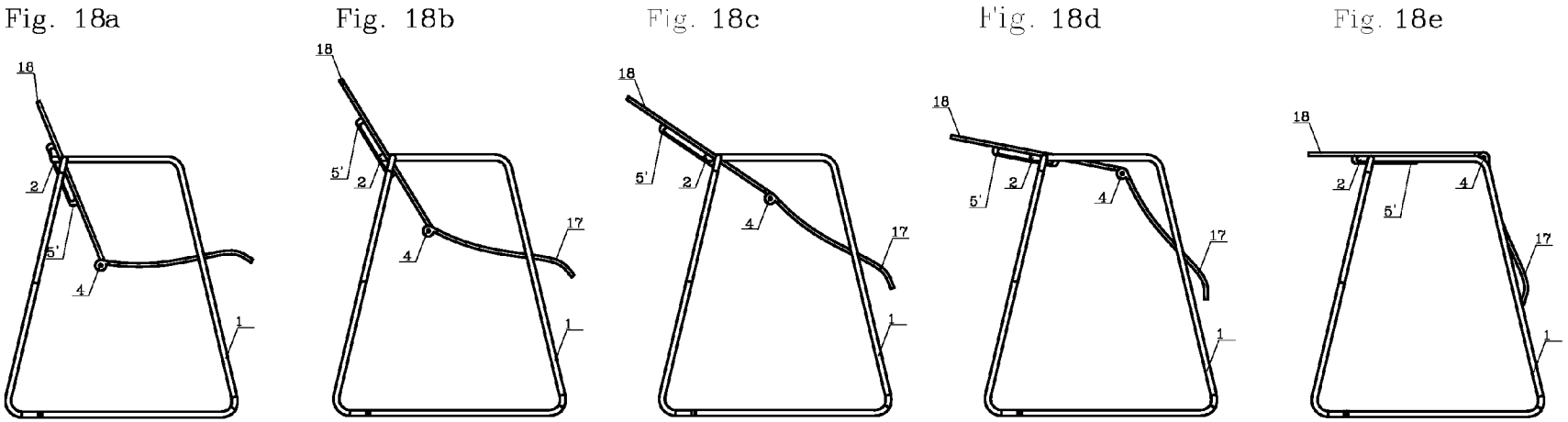
FIG. 18 is side view of chair according to the invention, showing the transformation from chair to desk (FIGS. 18*a*-18*e*).

According to a third and fourth embodiments of the invention, shown in FIGS. 13, 14, 15 and 16, 17, 18, respectively, the item of transformable furniture consists of two substantially flat elements 17, 18 linked directly by a hinge joint 4. The flat element 17 has a bent ergonomic shape, which remains unvaried in the transformation of the item of furniture from chair to worktop and vice versa, evident from the above-mentioned figures. The flat element 18 is flexible mainly in one direction, perpendicular to the direction of the grooves 18*a*, shown in FIG. 13, 14, 16, 17, and the element 18 is made so that it can change its shape from flat to concave in the transition from the position of worktop to the position of back and vice versa, from concave to flat in the transition from the position of back to the position of worktop. The first axis 2 is formed as an elongated, preferably cylindrical, bent element, lying in a horizontal plane, where the said first plate is made of a flexible flat element 18 linked to the said first axis 2 so that in the position of worktop said bent element 2 provides support for the worktop in the horizontal plane, while in the position of back the said bent element 2 can be pulled in the middle part of said flexible flat element 18 making the flexible flat element 18 take a concave shape, following the shape of the bent element 2. The flat element 17 and the flexible flat element 18 can rotate respectively round a first horizontal axis 2 and a second horizontal axis 3. The axes 2 and 3 are essentially the straight horizontal parts of the respective frames 1, 19. In this way the flat element 17 and the flexible flat element 18 can be moved between a first position as seat and back and a second position as front panel and worktop. The middle part 2*a* of the first horizontal axis 2 is bent in the horizontal plane of the axis, in moving the flexible flat element 18 from the position of worktop to the position of back the same is pulled by plate 5', which in the concrete exemplary embodiment performs the function of leading box. The hinge joint 20, which links frames 1 and 19, provides rotation and translation longitudinally along the two sides of frame 1. The hinge joint 21, which links frames 1' and 19, provides rotation. The hinge joint 16, which links frames 1 and 1', provides rotation.

In the fourth embodiment of the invention the supporting construction comprises two parallel horizontal axes 2, 3 located at different levels, fixed to two lateral vertical elements 1, and the flat element 17 and the flexible flat element 18, as described above, are linked by a hinge joint 4, the axis of which is parallel to the horizontal axes 2, 3. Axes 2 and 3 are located in the space enclosed by the couple of long sides of frame 1. The couple of long sides of frame 1 can be made as closed frames of trapezium shape. The same can be formed as closed or open frames of trapezium, rectangular, square or elliptic shape. The lateral vertical elements 1 can be made as solid elements. The middle part 2*a* of the first horizontal axis 2 is bent in the horizontal plane of the axis, in moving the flexible flat element 18 from the position of worktop to the position of back the flat element 18 is pulled by plate 5', which in the concrete exemplary embodiment performs the function of leading box.

Figure 19:
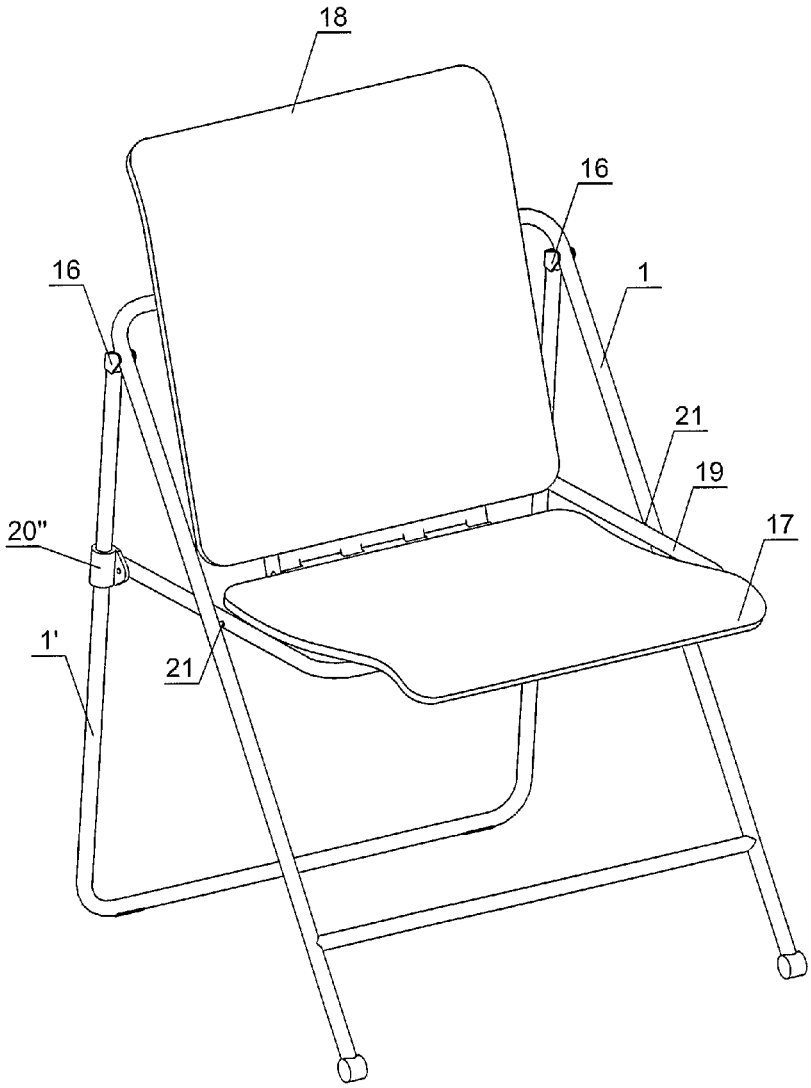
FIG. 19 is a perspective view of a further version of the item of transformable furniture in the position of chair.
Figure 20:
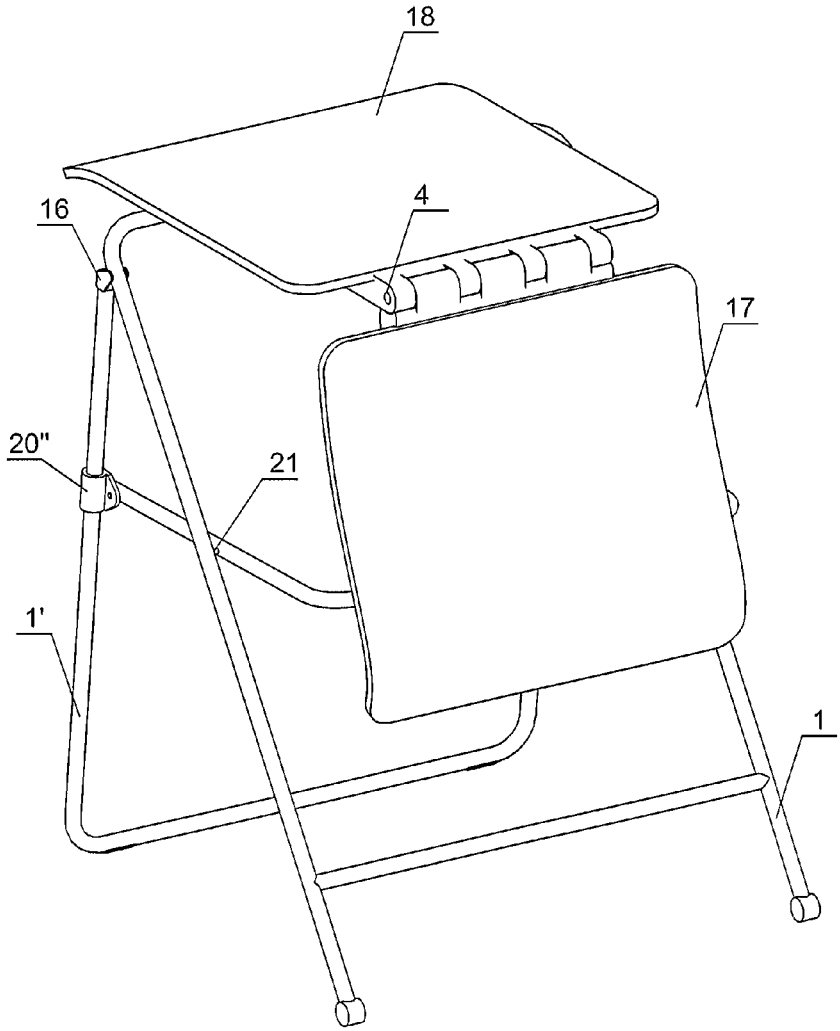
FIG. 20 is a perspective view of the item of transformable furniture in FIG. 19 in the position of desk.
Figure 23:
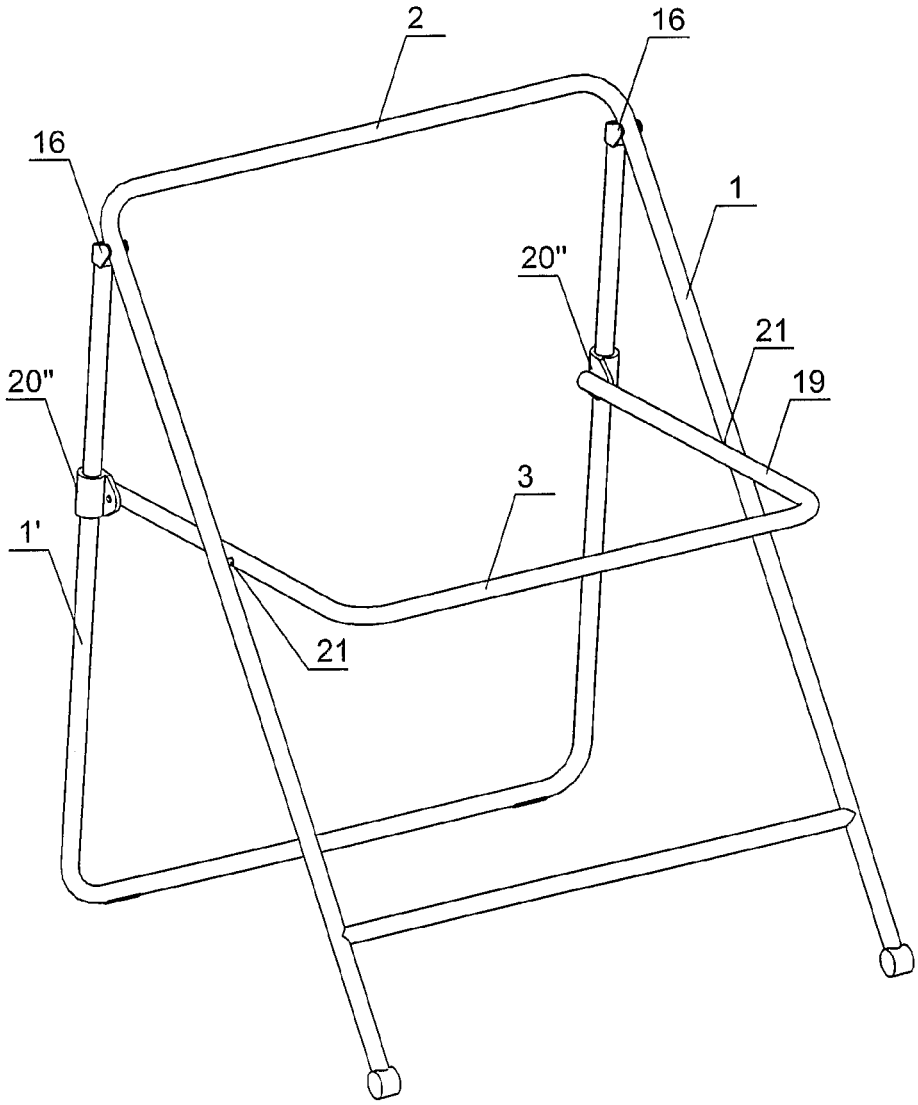
FIG. 23 is a perspective view of the supporting construction of the item of transformable furniture—chair, according to the invention.

According to a fifth embodiment of the invention, shown in FIG. 19-23, the item of transformable furniture consists of two substantially flat elements 17, 18 with attached plates 6, 5 by means of which the flat elements 17, 18 are connected by a hinge joint 4. The flat elements 17, 18 are not located in a plane but are bent in an ergonomic shape, shown in the figures, and can rotate round a first and a second horizontal axes 2, 3, respectively. As shown in the first exemplary embodiment, the two axes consist of the straight horizontal sections 2, 3 of two of the folding elements, embodied as tubular frames 1, 19 as best shown in FIG. 1-6. The axis 2 passes through slot 7 formed in the plate 5 attached to the first plate 18. The slot 7 allows translation and rotation movement round axis 2. The supporting construction consists of three tubular frames 1, 1', 19. In this way in unfolded position of the supporting construction the two flat elements 17, 18 can be moved between a first position as seat and back and a second position as front panel and worktop, as shown in FIG. 22*a* to 22*e*. By means of the axes 2, 3 the flat elements 17, 18 are attached to the supporting construction, which besides the two frames 1, 19 includes at least one more third frame 1' linked to them. Frame 19 is linked to the frames 1, 1' by two couples of hinge joints 20" and 21. A locking mechanism is located at hinge joint 21 that links frames 1 and 19, which provides rotation, while hinge joint 20" provides rotation and translation on the two sides of frame 1' by means of a locking mechanism. The locking mechanism is a slot, locking element and spring or T-shaped slipping bush, peg, spring and button. The front end of frame 19 descends until it is parallel to frame 1, while the lower end of frame 1' moves to a position parallel to frame 1 by rotation in hinge joint 16.

Figure 24:
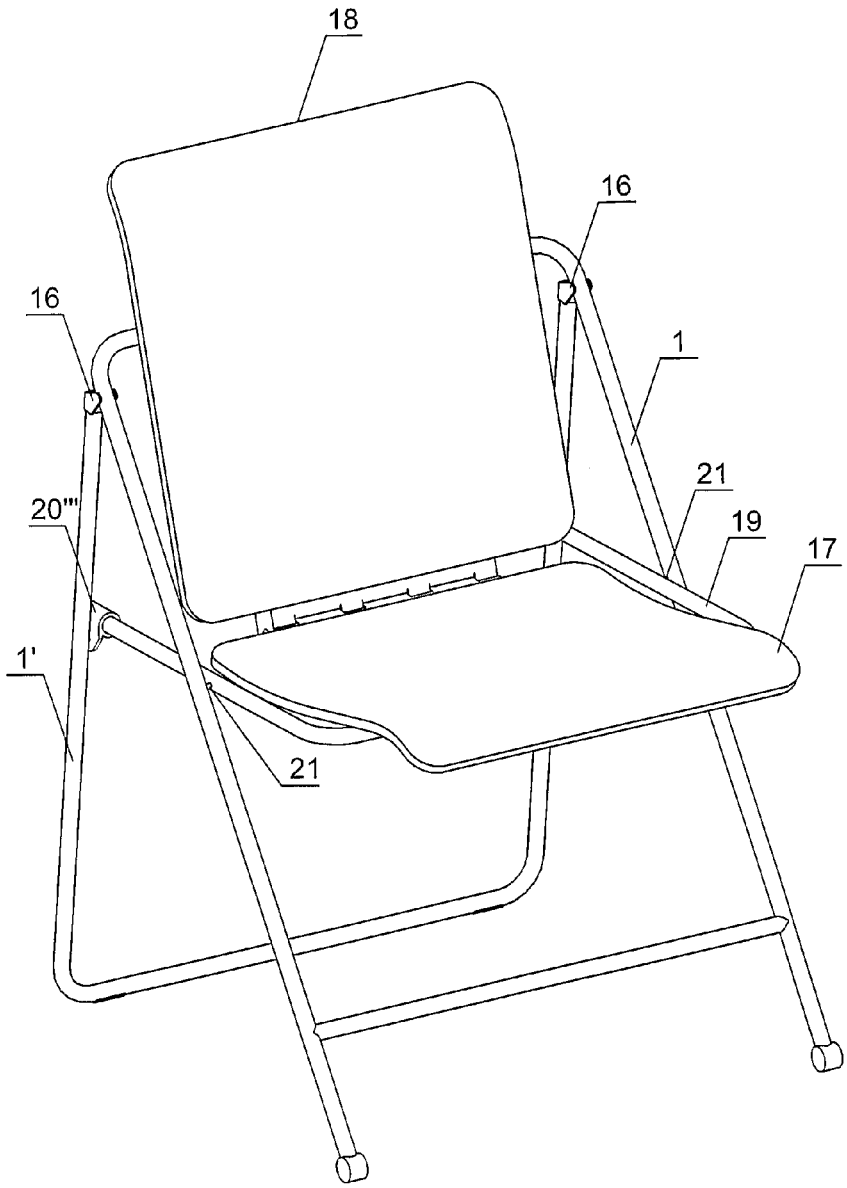
FIG. 24 is a perspective view of a further version of the item of transformable furniture in the position of chair.
Figure 25:
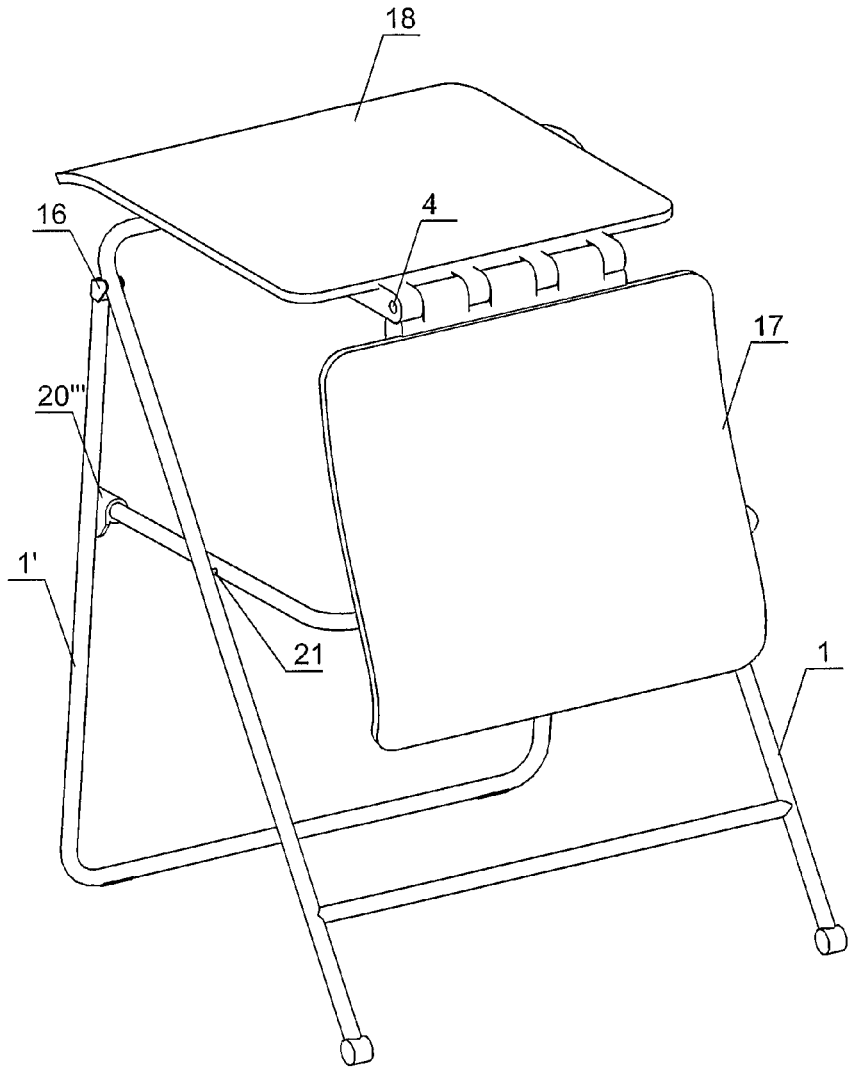
FIG. 25 is a perspective view of a further version of the item of transformable furniture in the position of desk.
Figure 28:
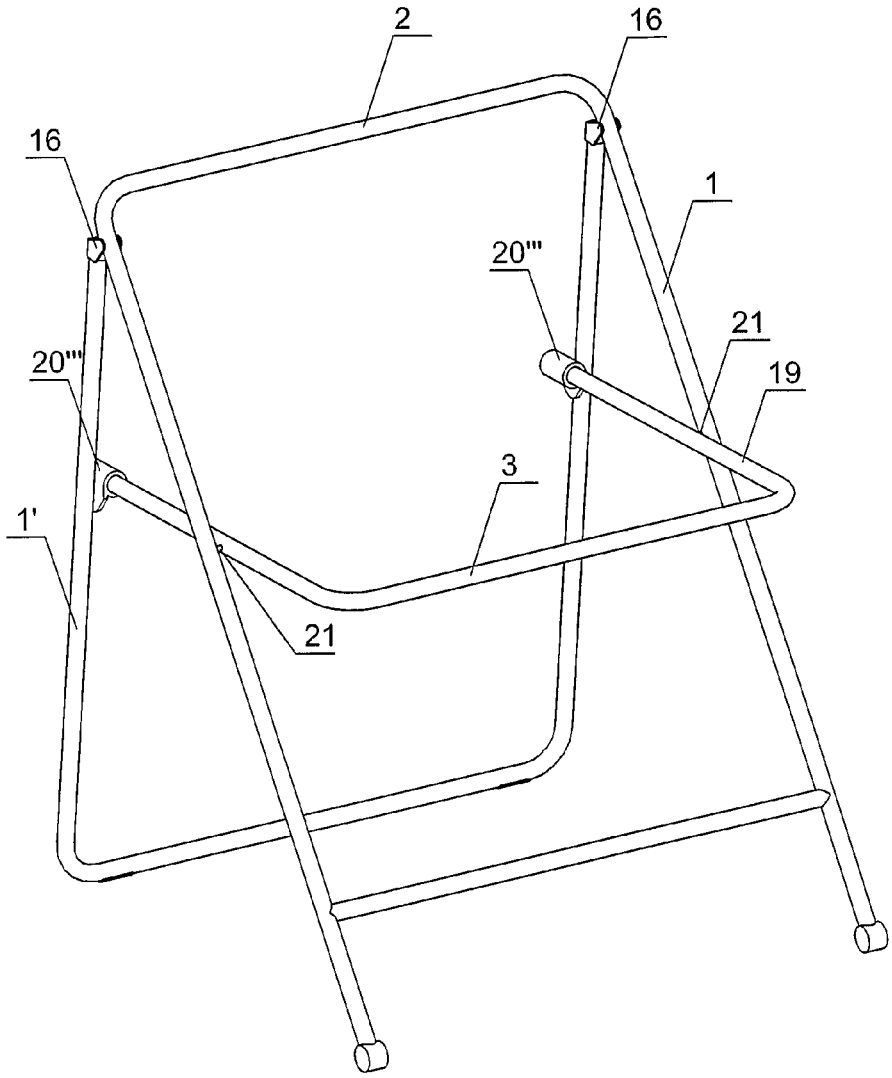
FIG. 28 is a perspective view of the supporting construction of a version of the folding item of transformable furniture—chair, according to the invention.

According to a sixth embodiment of the invention, shown in FIG. 24-28, the item of transformable furniture consists of two substantially flat elements 17, 18 with attached plates 6, 5 by means of which the flat elements 17, 18 are connected by a hinge joint 4. The flat elements 17, 18 are not located in a plane but are bent in an ergonomic shape, shown in the figures, and can rotate round a first and a second horizontal axes 2, 3, respectively. As shown in the first exemplary embodiment, the two axes consist of the straight horizontal sections 2, 3 of two of the folding elements, embodied as tubular frames 1, 19 as best shown in FIG. 1-6. The axis 2 passes through slot 7 formed in the plate 5 attached to the first plate 18. The slot 7 allows translation and rotation movement round axis 2. The supporting construction consists of three tubular frames 1, 1', 19. In this way in unfolded position of the supporting construction the two flat elements 17, 18 can be moved between a first position as seat and back and a second position as front panel and worktop, as shown in FIG. 27*a* to 27*j*. By means of the axes 2, 3 the flat elements 17, 18 are attached to the supporting constriction, which besides the two frames 1, 19 includes at least one more third frame 1' linked to them. Frame 19 is linked to the frames 1, 1' by two couples of hinge joints 20''' and 21. The hinge joint 21 provides rotation, while the hinge joint 20''' provides rotation and translation forward on the two sides of frame 19 by means of a locking mechanism, where the front end of frame 19 descends until it is parallel to frame 1, while the lower end of frame 1' moves to a position parallel to frame 1 by rotation in hinge joint 16.

Figure 29:
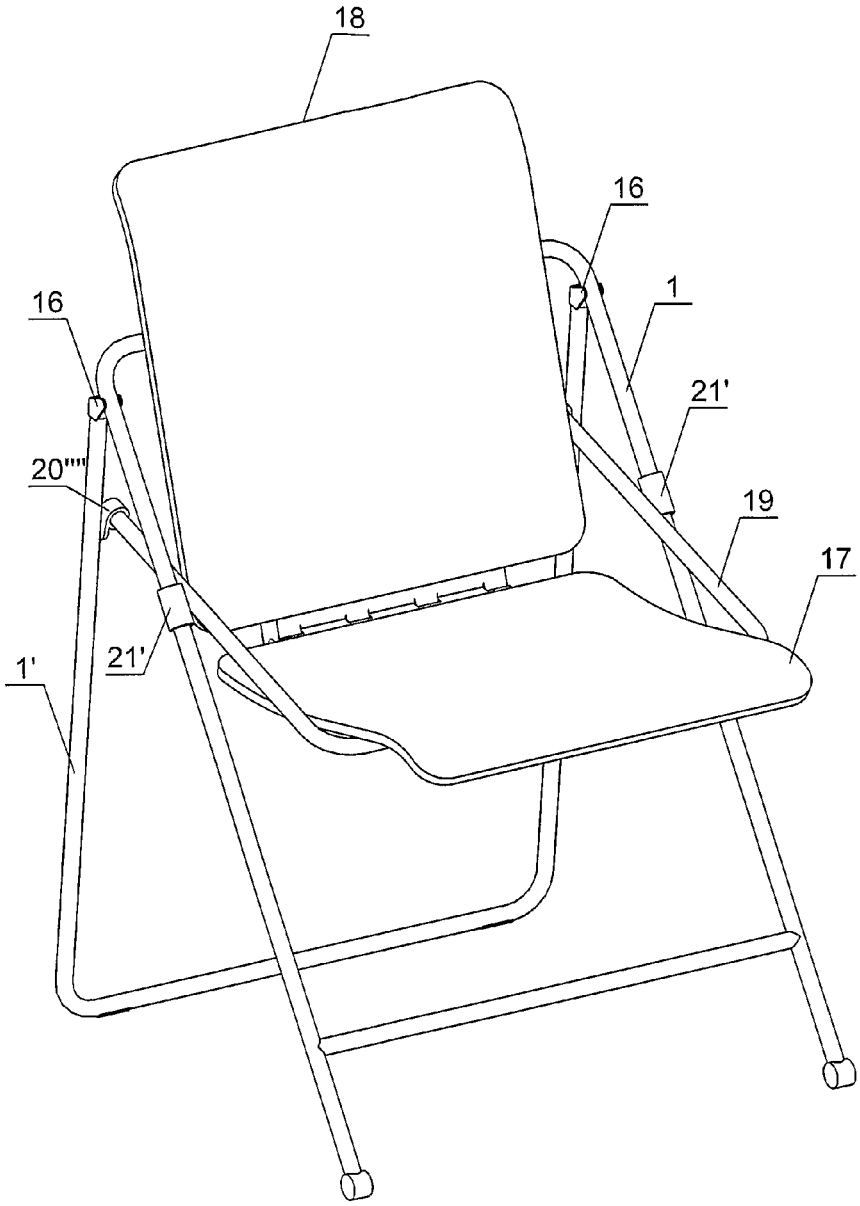
FIG. 29 is a perspective view of a further version of the item of transformable furniture in the position of chair, according to the invention.
Figure 30:
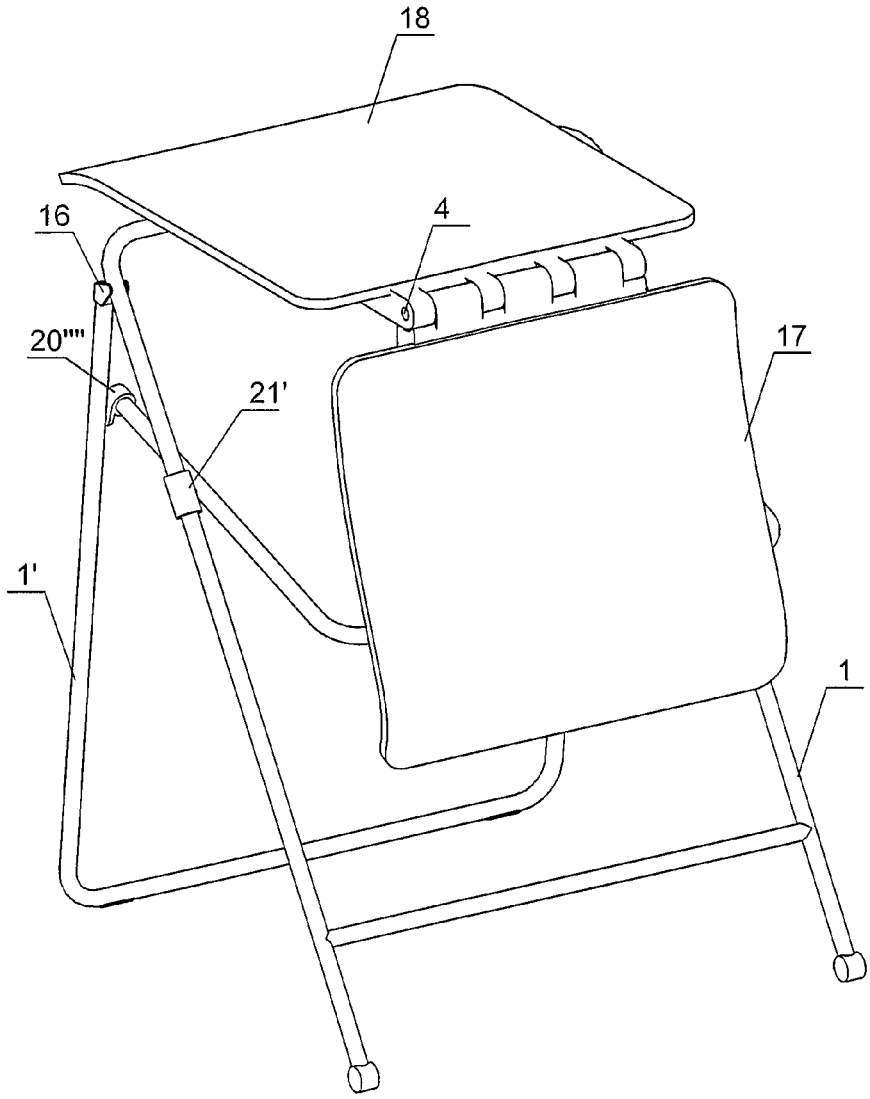
FIG. 30 is a perspective view of a further version of the item of transformable furniture in the position of desk, according to the invention.
Figure 33:
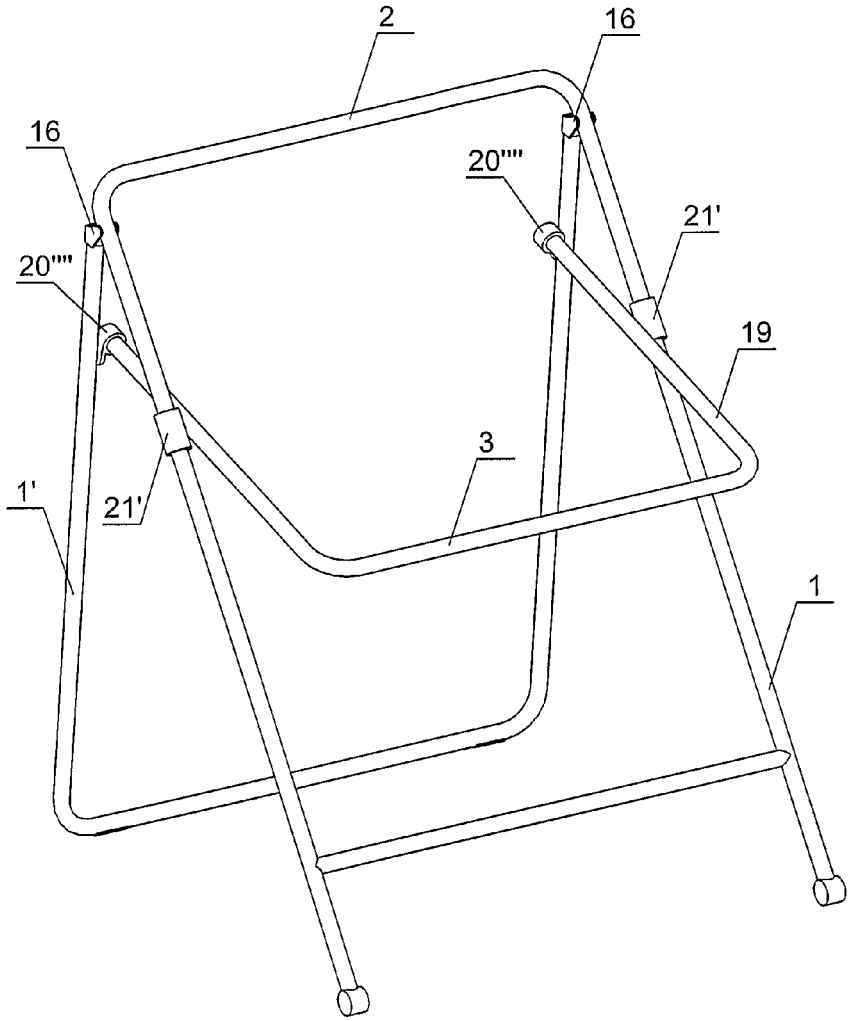
FIG. 33 is a perspective view of the supporting construction of a version of the folding item of transformable furniture—chair, according to the invention.

According to a seventh embodiment of the invention, shown in FIG. 29-33, the item of transformable furniture consists of two substantially flat elements 17, 18 with attached plates 6, 5 by means of which the flat elements 17, 18 are connected by a hinge joint 4. The flat elements 17, 18 are not located in a plane but are bent in an ergonomic shape, shown in the figures, and can rotate round a first and a second horizontal axes 2, 3, respectively. As shown in the first exemplary embodiment, the two axes consist of the straight horizontal sections 2, 3 of two of the folding elements, embodied as tubular frames 1, 19 as best shown in FIG. 1-6. The axis 2 passes through slot 7 formed in the plate 5 attached to the first plate 18. The slot 7 allows translation and rotation movement round axis 2. The supporting construction consists of three tubular frames 1, 1', 19. In this way in unfolded position of the supporting construction the two flat elements 17, 18 can be moved between a first position as seat and back and a second position as front panel and worktop, as shown in FIG. 32*a* to 32*j*. By means of the axes 2, 3 the flat elements 17, 18 are attached to the supporting construction, which besides the two frames 1, 19 includes at least one more third frame 1' linked to them. Frame 19 is linked to the frames 1, 1' by two couples of hinge joints 20'''' and 21'. The hinge joint 21' provides rotation, while hinge joint 20'''' provides rotation and translation forward on the two sides of frame 19 by means of a locking mechanism, where the front end of frame 19 descends until it is parallel to frame 1, while the lower end of frame 1' moves to a position parallel to frame 1 by rotation in hinge joint 16.

Figure 34:
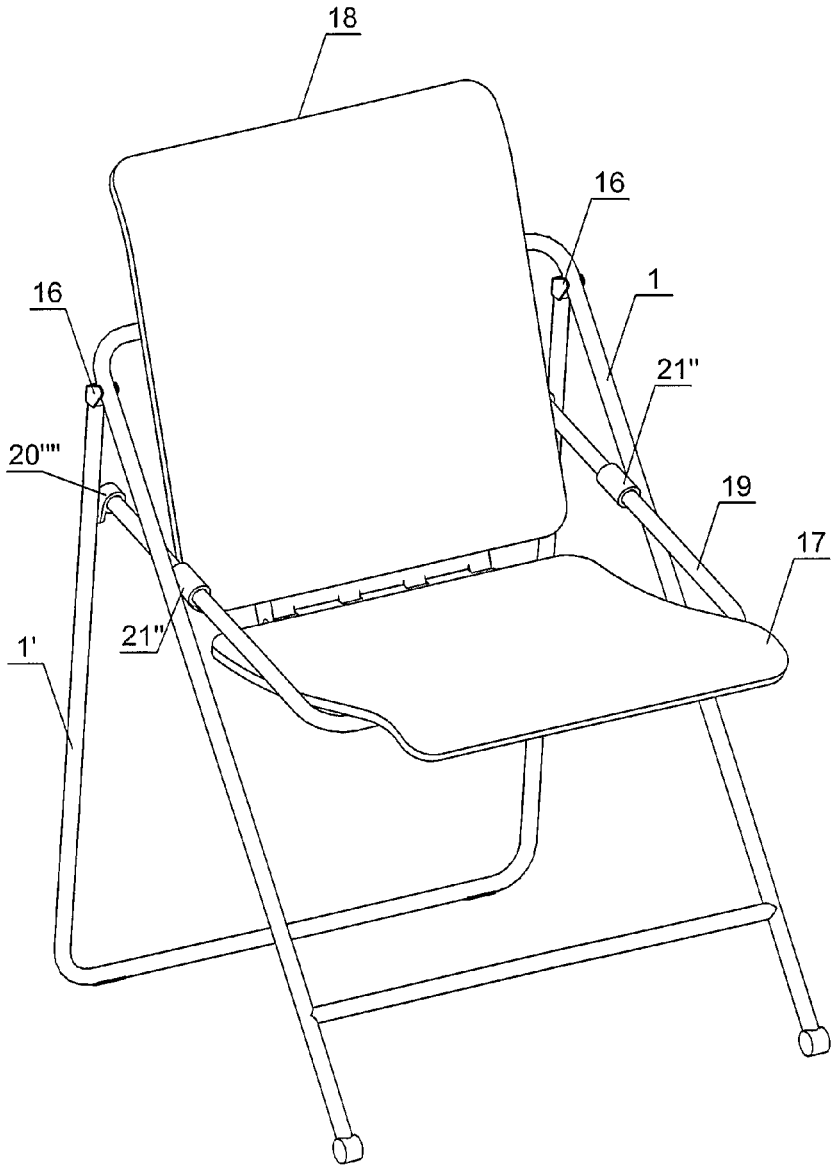
FIG. 34 is a perspective view of a further version of the item of transformable furniture in the position of chair, according to the invention.
Figure 35:
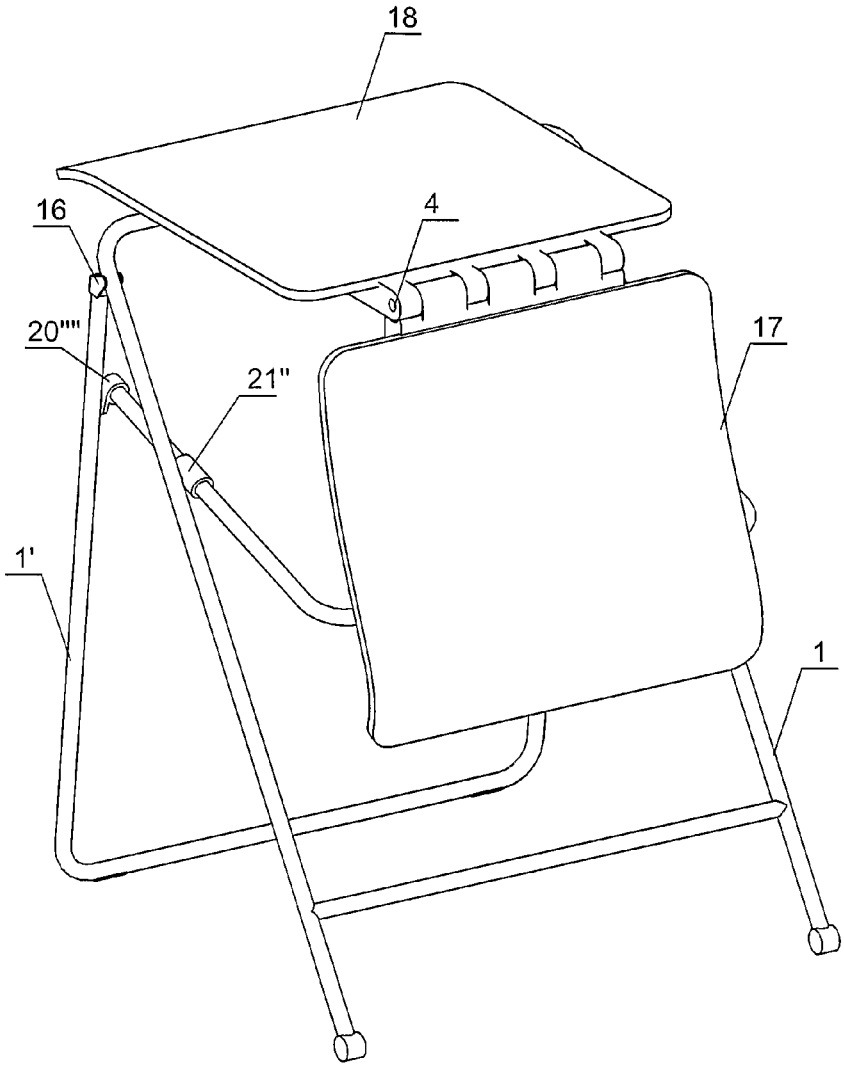
FIG. 35 is a perspective view of a further version of the item of transformable furniture in the position of desk, according to the invention.
Figure 38:
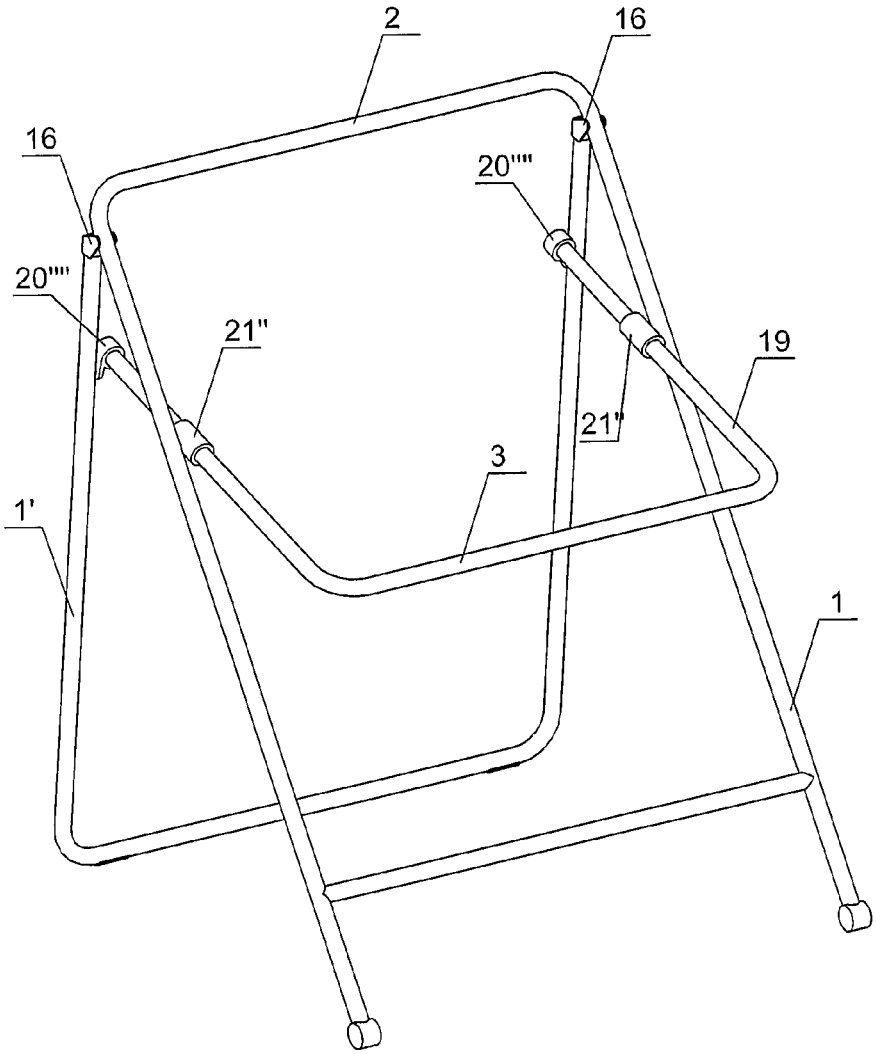
FIG. 38 is a perspective view of the supporting construction of a version of the folding item of transformable furniture—chair, according to the invention.

According to an eighth embodiment of the invention, shown in FIG. 34-38, the item of transformable furniture consists of two substantially flat elements 17, 18 with attached plates 6, 5 by means of which the flat elements 17, 18 are connected by a hinge joint 4. The flat elements 17, 18 are not located in a plane but are bent in an ergonomic shape, shown in the figures, and can rotate round a first and a second horizontal axes 2, 3, respectively. As shown in the first exemplary embodiment, the two axes consist of the straight horizontal sections 2, 3 of two of the folding elements, embodied as tubular frames 1, 19 as best shown in FIG. 1-6. The axis 2 passes through slot 7 formed in the plate 5 attached to the first plate 18. The slot 7 allows translation and rotation movement round axis 2. The supporting construction consists of three tubular frames 1, 1', 19. In this way in unfolded position of the supporting construction the two flat elements 17, 18 can be moved between a first position as seat and back and a second position as front panel and worktop, as shown in FIG. 38*a* to 38*j*. By means of the axes 2, 3 the flat elements 17, 18 are attached to the supporting construction, which besides the two frames 1, 19 includes at least one more third frame 1' linked to them. Frame 19 is linked to the frames 1, 1' by two couples of hinge joints 20'''' and 21''. The hinge joint 20'''' provides rotation, while the hinge joint 21'' provides rotation and translation backwards on the two sides of frame 19 by means of a locking mechanism, where the front end of frame 19 descends until it is parallel to frame 1, while the lower end of frame 1' moves to a position parallel to frame 1 by rotation in the hinge joint 16.

Figure 39:
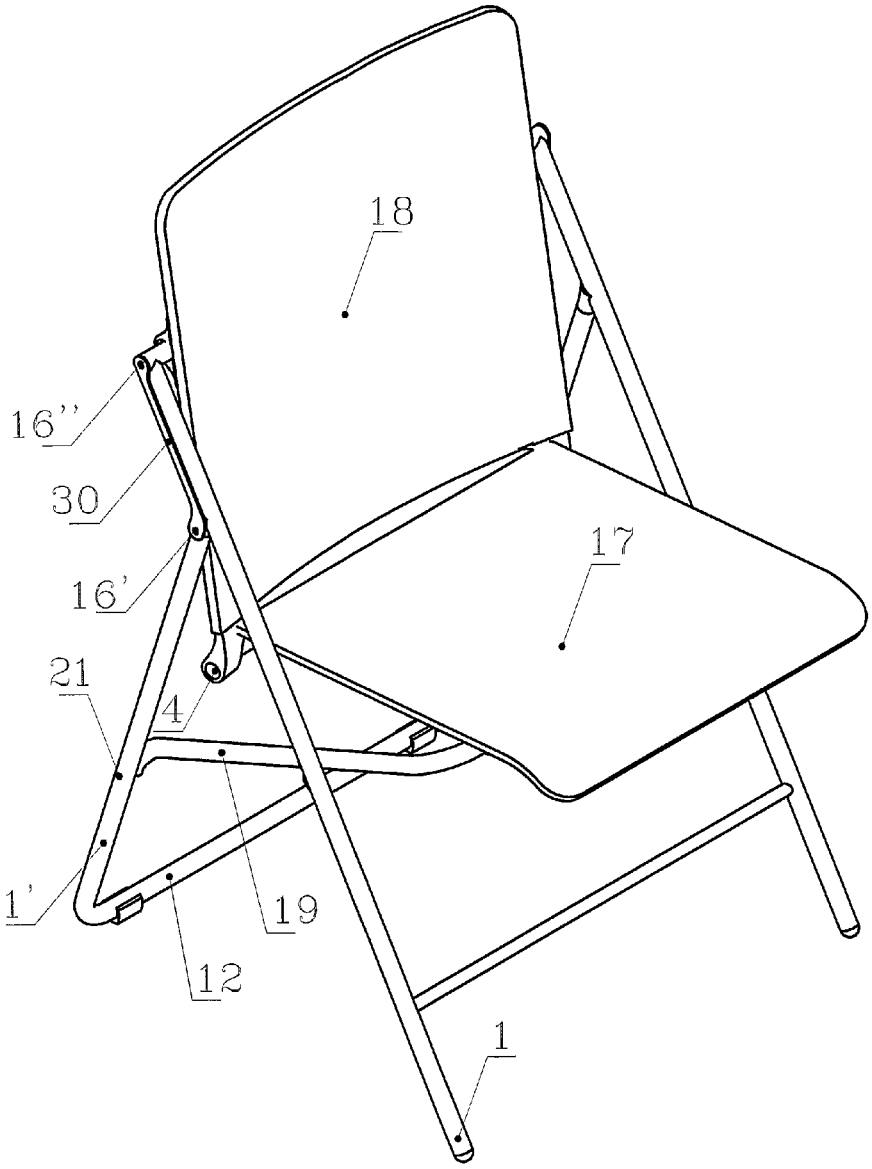
FIG. 39 is a perspective view of a further version of the item of transformable furniture in the position of chair, according to the invention.
Figure 40:
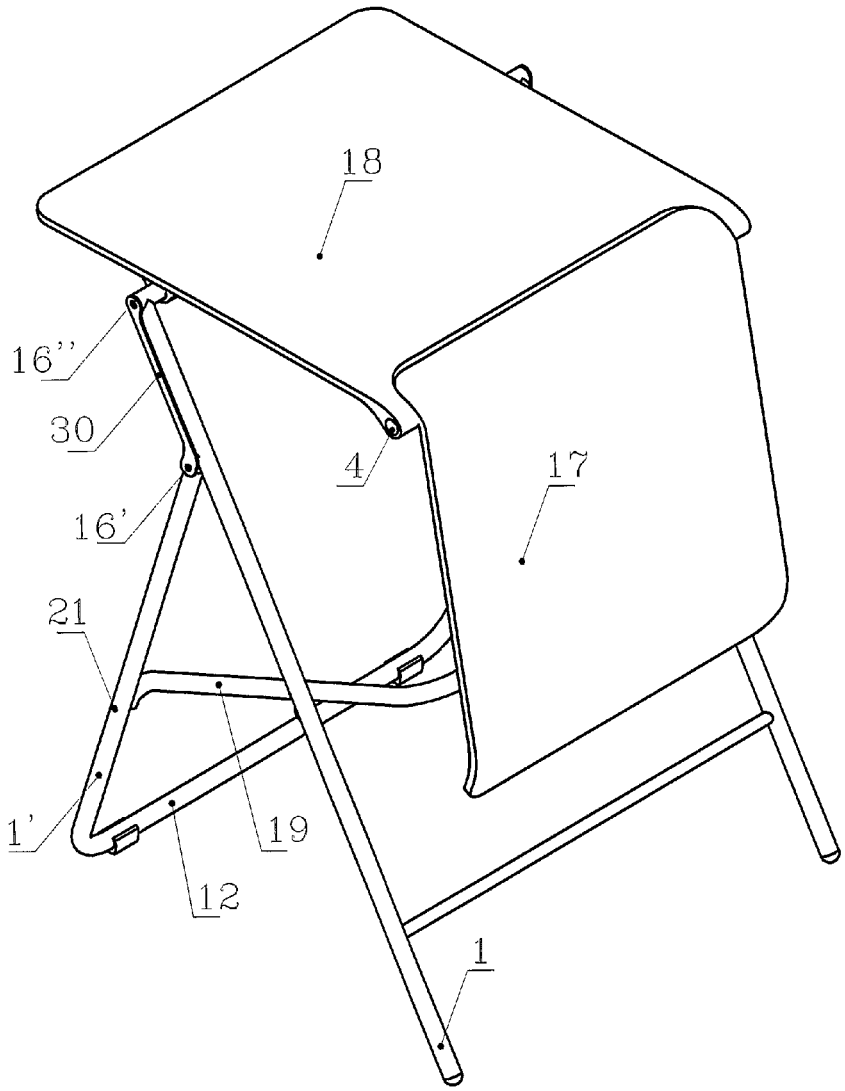
FIG. 40 is a perspective view of a further version of the item of transformable furniture in the position of desk, according to the invention.
Figure 43:
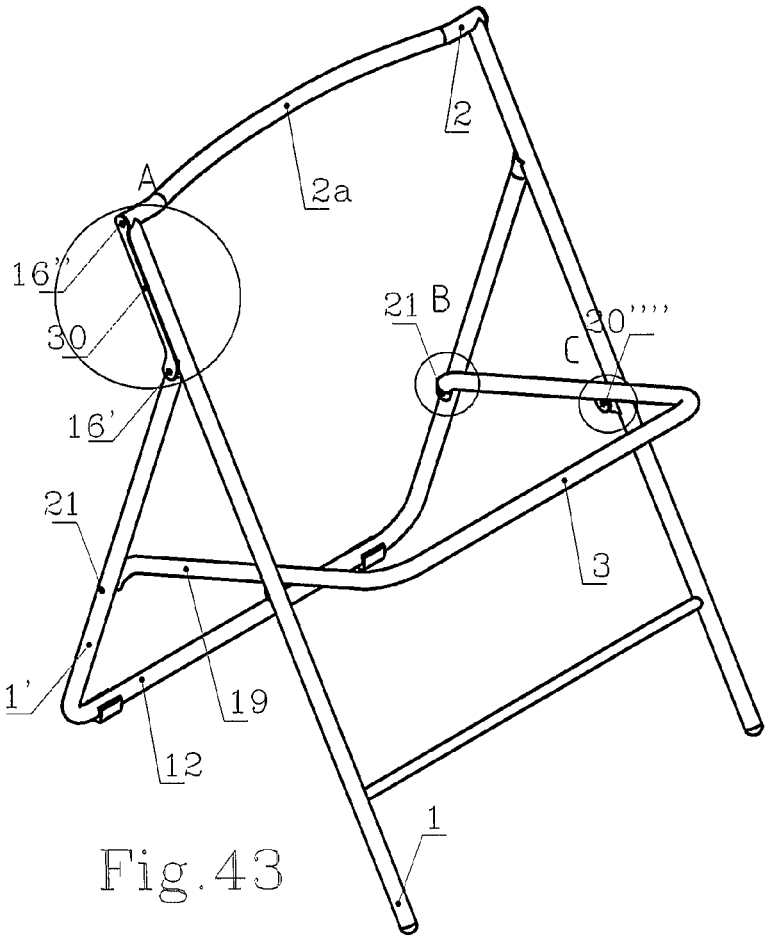
FIG. 43 is a perspective view of the supporting construction of a version of the folding item of transformable furniture—chair, according to the invention.
Figure 43A:
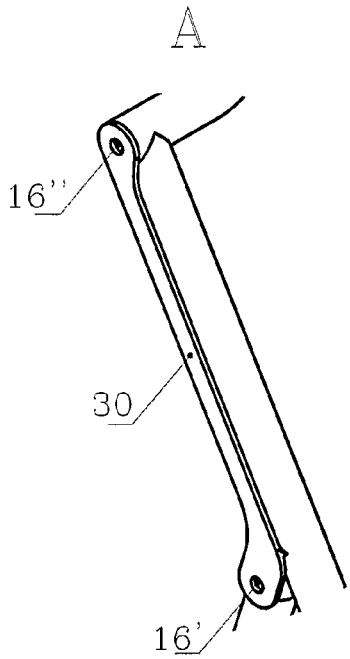
Figure 43B:
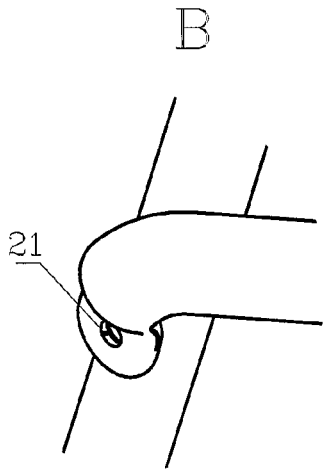
Figure 43C:
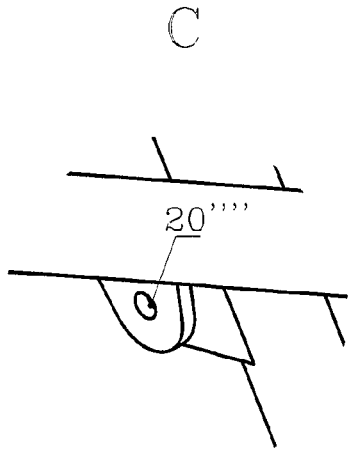

According to a ninth embodiment of the invention, shown in FIG. 39-43, the item of transformable furniture consists of substantially flat elements seat 17 and back 18, respectively front panel 17 and worktop 18, connected by a hinge joint 4. The seat 17 and back 18 are not located in a plane but are bent in an ergonomic shape, shown in the figures, and can rotate round a first and a second horizontal axes 2, 3, respectively. As shown in the third exemplary embodiment, the first axis 2 is formed as an elongated, preferably cylindrical, bent element, lying in a horizontal plane, where the said back 18 is a flexible flat element linked to the said first axis 2 so that in the position of worktop said bent element 2 provides support for the work-top in the horizontal plane. The flat element 17 and the flexible flat element 18 can rotate respectively round a first horizontal axis 2 and a second horizontal axis 3. The axes 2 and 3 are essentially the straight horizontal parts of the respective frames 1, 19. In this way the flat element 17 and the flexible flat element 18 can be moved between a first position as seat and back and a second position as front panel and worktop. The middle part 2*a* of the first horizontal axis 2 is bent in the horizontal plane of the axis, in moving the flexible flat element 18 from the position of worktop to the position of back. The axis 2 passes through fastening devices on the flat element 18. The supporting construction consists of three tubular frames 1, 1', 19. In unfolded position of the supporting construction the two flat elements 17, 18 can be moved between a first position as seat and back and a second position as front panel and worktop, as shown in FIG. 42*a* to 42*j*. By means of the axes 2, 3 the flat elements 17, 18 are attached to the supporting construction, which besides the two frames 1, 19 includes at least one more third frame 1' linked to them. Frame 19 is linked to the frames 1, 1' by two couples of hinge joints 20'''' and 21. The hinge joints 20'''' and 21 provide rotation. Frame 1 is linked to flame 1' by means of two couples of hinge joints 16' and 16'' and plate 30. The hinge joints 16' and 16'' provide rotation. The unfolding, respectively folding, of the supporting construction takes place as plate 30 turns to 180° in the upper end of frame 1 by rotation in the hinge joints 16' and 16'' and rotation in the hinge joints 20'''', 21, where the frames 1, 1' and 19 in an intermediary position are aligned and parallel.

The invention claimed is:

1. An item of transformable furniture, comprising:

a supporting construction, comprising three interconnected folding elements, formed as frames and interconnected by couples of hinge joints, where one of the couples of hinge joints can slide with respect to one of the folding elements, with the first and second of the three interconnected folding elements being U-shaped tubular frames, each of which has a middle part and two legs, the respective middle parts defining a first and a second axis and the legs thereof joined together by the couple of sliding hinge joints;

a first and a second plate, the first plate linked to the first of the folding elements along the first axis and the second plate linked to the second of the folding elements along the second axis; and a hinge joint that foldably and independently from the folding elements connects the respective plates along a hinge axis, such that, in a first position, the first and second plate are arranged as a seat and a back, and, in a second position, the first and second plate are arranged as a front panel and a worktop, the first and second positions achieved by rotation about the respective axes.

2. The item of transformable furniture of claim 1, wherein: the legs of one of the first and second folding elements are joined so as to form a closed quadrangular frame, and a locking mechanism is associated with the couple of sliding hinge joints.

3. The item of transformable furniture of claim 1, wherein: a section of the second folding element has a bend, and the second plate, made of a flexible flat element, is joined to the second folding elements, such that when the second plate rotates about the second axis from its first to second positions, the bend causes the plate to deform from a substantially flat form as a worktop to a substantially concave form and vice versa.

4. The item of transformable furniture of claim 3, wherein: the bent section of the second folding element is in the form of an elongated element, and the second plate is attached to the bent section so that it can rotate, so that in the first position of worktop the bent section serves as three-point support, supporting the worktop in a plane, while in the second position of back, the bent section pulls the flexible element that touches the ends of the elongated element, shaping it so that the substantially concave form follows the shape of the bent section.

5. The item of transformable furniture of claim 4, wherein the elongated element is cylindrical.

6. The item of transformable furniture of claim 1, further comprising:

a locking device associated with at least one folding element that fixes the respective relative position of two or more of the folding elements.

7. The item of transformable furniture of claim 6, wherein: at least one of the first and second folding elements is attached to the corresponding plate so that the plate can slide and move the position of the plate's rotation relative to the axis, where the position of the rotation with respect to the axis fixed by means of a further locking device.

8. The item of transformable furniture of claim 6, wherein: the locking device is comprised of a slot locking element and spring mechanism, or a T-shaped slipping bush, peg, spring, and button mechanism.

9. The item of transformable furniture of claim 1, wherein: there are at least three couples of hinge joints, and one couple of hinge joints is capable of rotation and translation, a second couple of hinge joints is capable of rotation only, and a third couple of hinge joints is capable of rotation or translation.

10. The item of transformable furniture of claim 9, wherein:

at least two of the folding element frames have a middle part and two long sides, and a couple of slots formed longitudinally in the long sides of one of the frames, where at one end the slots end in a circular opening, while at the opposite end they end in a curve, formed as an arc-shaped cutout providing for bayonet locking/unlocking of the supporting construction in unfolded/folded position respectively.

11. The item of transformable furniture of claim 9, wherein:

at least two of the folding element frames each have a middle part and two long sides, and a couple of T-shaped slipping bushes located at the long sides of one of the frames can move along the long sides of the respective frame and together with a peg, spring, and button mechanism provide locking/unlocking of the supporting construction in unfolded/folded position respectively.

12. An item of transformable furniture, comprising:

a first plate and a second plate, linked to each other by a horizontal hinge joint;

a first horizontal axis parallel to an axis of the horizontal hinge joint and associated with the first plate such that the first plate can rotate around said first horizontal axis, and a second horizontal axis parallel to the axis of said the horizontal hinge joint and associated with the second plate such that the second plate can rotate about the second horizontal axis, where the two plates can rotate around the first and second horizontal axes respectively so that the first plate and the second plate can be moved from a first position as seat and back, respectively, to a second position as front panel and worktop, respectively, and where the second axis is in the form of an elongated element, lying in a horizontal plane, with a bent section, and the second plate, made of a flexible flat element, and serving as back and worktop, is joined to the second axis such that when it is moved from a back position to a worktop position it deforms in shape from a substantially concave form as back to a substantially flat form as worktop and vice versa.

13. The item of transformable furniture of claim 12, wherein:

the second plate is attached to the bent section so that it can rotate, and so that in the position of worktop the bent section serves as three-point support, supporting the worktop in a plane, while in the position of back, the bent section pulls the flexible element that touches the ends of the elongated element, shaping it so that the flexible element takes a concave shape, following the shape of the bent section.

14. The item of transformable furniture of claim 13, wherein:

the flexible element has a varying ability of deformation throughout.

15. An item of transformable furniture, comprising:

a seat and a back, connected by a horizontal hinge joint, where the seat and back can rotate respectively around a first horizontal axis and a second horizontal axis so that the seat and back can be moved from a first position as seat and back, to a second position as front panel and worktop, respectively, and vice versa, and a supporting construction that consists of at least three interconnected folding elements, where at least two of the folding elements have horizontal sections that form the first and second horizontal axes, and the same two folding elements are connected by hinge joints with a plate, which is attached by hinge joints to the upper end of the two folding elements, such that when the plate is engaged, the relative positions of the two folding elements changes, causing the seat and back to rotate about their respective axes and change from first to second position and vice versa.

16. The item of transformable furniture of claim 15, wherein:

the plate can rotate up to 180° around its respective hinge joints.

* * * * *